US007900920B2

(12) United States Patent
Sakai et al.

(10) Patent No.: US 7,900,920 B2
(45) Date of Patent: Mar. 8, 2011

(54) RECORDING MEDIUM TRANSPORT DEVICE IN IMAGE RECORDING APPARATUS

(75) Inventors: Tomoyuki Sakai, Kyoto (JP); Shoji Kakimoto, Kyoto (JP)

(73) Assignee: Dainippon Screen MFG. Co., Ltd., Kyoto (JP)

( * ) Notice: Subject to any disclaimer, the term of this patent is extended or adjusted under 35 U.S.C. 154(b) by 208 days.

(21) Appl. No.: 12/399,245

(22) Filed: Mar. 6, 2009

(65) Prior Publication Data

US 2009/0295080 A1 Dec. 3, 2009

(30) Foreign Application Priority Data

May 28, 2008 (JP) ..... 2008-139766

(51) Int. Cl.
*B65H 29/32* (2006.01)
*B41J 2/01* (2006.01)

(52) U.S. Cl. ..... 271/275; 271/197; 198/689.1; 347/104

(58) Field of Classification Search ..... 271/275, 271/196, 197, 198, 258.01, 265.04; 347/8, 347/104; 198/689.1, 803.5
See application file for complete search history.

(56) References Cited

U.S. PATENT DOCUMENTS

| | | | | |
|---|---|---|---|---|
| 4,719,721 | A * | 1/1988 | Stump | 451/300 |
| 5,225,852 | A | 7/1993 | Uchida et al. | |
| 6,230,876 | B1 * | 5/2001 | Gilberti et al. | 198/803.5 |
| 7,118,103 | B2 * | 10/2006 | Greive | 271/275 |
| 2009/0244243 | A1 * | 10/2009 | Nakagawa et al. | 347/104 |

FOREIGN PATENT DOCUMENTS

| | | |
|---|---|---|
| JP | 02-080269 | 3/1990 |
| JP | 02-187355 | 7/1990 |
| JP | 4-219264 | 8/1992 |
| JP | 2004-314605 | 11/2004 |
| JP | 2005-131929 | 5/2005 |
| JP | 2006-224039 | 8/2006 |
| WO | WO 2006/120163 A1 | 11/2006 |

OTHER PUBLICATIONS

Extended European Search Report Issued in European Patent Application No. EP 09003226.9-1251, dated May 12, 2009.

* cited by examiner

*Primary Examiner* — Kaitlin S Joerger
(74) *Attorney, Agent, or Firm* — McDermott Will & Emery LLP

(57) ABSTRACT

An image recording apparatus includes a plurality of linear motor mechanisms for transporting a plurality of tables in a first transport section including at least an area in which an image is recorded on recording media, and an endless transport mechanism for transporting the plurality of tables in at least a second transport section contiguous with the first transport section and capable of transporting the plurality of tables in the first transport section. The image recording apparatus further includes an unused linear motor mechanism determination part for determining an unused linear motor mechanism. When the unused linear motor mechanism is determined, the endless transport mechanism is used as an alternative to transport at least one of the tables which is to be transported in the first transport section but which is able to be transported by none of the plurality of linear motor mechanisms. If a malfunctioning linear motor mechanism is present because of a breakage, an operation anomaly and the like, the image recording apparatus achieves the image recording while maintaining the accuracy of the recorded image although the throughput thereof decreases.

10 Claims, 19 Drawing Sheets

RECORDING MEDIUM TRANSPORT DEVICE IN IMAGE RECORDING APPARATUS

BACKGROUND OF THE INVENTION

1. Field of the Invention

The present invention relates to a device for transporting a recording medium in an apparatus for recording a predetermined image on the recording medium while transporting the recording medium.

2. Description of the Background Art

Conventionally, there is known an image recording apparatus in which, while a transport means including rollers, a belt and the like is used to transport a recording medium such as printing paper and the like, ink is ejected from a multiplicity of inkjet nozzles arranged in a direction orthogonal to the transport direction of the recording medium onto the recording medium being transported, to thereby record an image on the recording medium. Such an image recording apparatus is disclosed, for example, in Japanese Patent Application Laid-Open Nos. 2-80269 (1990), 2-187355 (1990), 4-219264 (1992), 2005-131929, and 2004-314605.

The image recording apparatus as disclosed in the above-mentioned cited references is capable of doing a large amount of printing at a high speed, but presents a problem in finding difficulties in recording an image with high accuracy on a recording medium because of vibrations created by the rollers, the belt and the like when in operation.

To solve the problem, another image recording apparatus has been proposed. While transporting a recording medium principally using a transport means including rollers, a belt and the like, this image recording apparatus records an image on the recording medium after the transport of the recording medium is changed from the transport using the transport means including the rollers, the belt and the like to the transport using a plurality of linear motor mechanisms capable of more accurate transport than using the rollers, the belt and the like at least during image recording. Such an image recording apparatus is capable of doing a large amount of printing at a high speed with high accuracy.

However, the image recording apparatus which uses the plurality of linear motor mechanisms to transport the recording medium presents a problem such that, if any one of the linear motor mechanisms malfunctions, the printing process is suspended or there arises a need to transport the recording medium by using the transport means including the rollers, the belt and the like, rather than the linear motor mechanisms, during the image recording.

SUMMARY OF THE INVENTION

The present invention is intended for an image recording apparatus for recording an image on recording media.

According to the present invention, the image recording apparatus comprises: a) an image recording part for recording an image on recording media; and b) a recording medium transport device for transporting the recording media stocked in a predetermined stocking part, the recording medium transport device including b-1) a plurality of tables for holding the recording media thereon, b-2) a supply part for supplying the recording media to each of the plurality of tables, b-3) a plurality of linear motor mechanisms for transporting the plurality of tables in a first transport section including at least an area in which The image recording part records an image on the recording media, b-4) an endless transport mechanism for transporting the plurality of tables in at least a second transport section contiguous with the first transport section and capable of transporting the plurality of tables in the first transport section, and b-5) an unused linear motor mechanism determination part for determining an unused linear motor mechanism to be unused for the transport of the plurality of tables from among the plurality of linear motor mechanisms, the plurality of linear motor mechanisms and the endless transport mechanism being provided so that the plurality of tables are used sequentially and circularly for the transport in the first transport section, wherein, when the unused linear motor mechanism is not determined, all of the plurality of linear motor mechanisms are used for the transport of the plurality of tables in the first transport section, and wherein, when the unused linear motor mechanism is determined, the endless transport mechanism is used as an alternative to transport at least one of the plurality of tables which is to be transported in the first transport section but which is able to be transported by none of the plurality of linear motor mechanisms.

If a malfunctioning linear motor mechanism is present because of a breakage, an operation anomaly and the like, the image recording apparatus achieves continuous image recording although the throughput thereof decreases. This suppresses the reduction in productivity, as compared with the complete stop of the image recording apparatus.

Preferably, the recording medium transport device further includes b-6) a supply timing determination part for determining supply timing indicative of when to supply the recording media from the supply part in accordance with the condition of transport of the plurality of tables, the supply timing determination part determining the supply timing so that, if an alternative transport table to be transported by the endless transport mechanism as a alternative in the first transport section is present among the plurality of tables, the recording media are not supplied from the supply part to the alternative transport table. The supply part supplies the recording media to the plurality of tables, based on the supply timing determined by the supply timing determination part.

During the image recording, no recording medium is supplied to a table which is not transported by the linear motor mechanisms. If a malfunctioning linear motor mechanism is present because of a breakage, an operation anomaly and the like, the image recording apparatus achieves the image recording while maintaining the accuracy of the recorded image although the throughput thereof decreases.

Preferably, the number of linear motor mechanisms provided in the recording medium transport device is greater by at least two than a simultaneous transport table count which is the number of tables included among the plurality of tables and transported at the same time in the first transport section. The plurality of linear motor mechanisms except the unused linear motor mechanism are used to transport the plurality of tables in the first transport section when the sum of the number of unused linear motor mechanisms and the simultaneous transport table count is less than the number of linear motor mechanisms provided in the recording medium transport device. The endless transport mechanism is used as an alternative for the transport only when the sum of the number of unused linear motor mechanisms and the simultaneous transport table count is not less than the number of linear motor mechanisms provided in the recording medium transport device.

If at least one of the linear motor mechanisms cannot be used for the transport because of a breakage, an operation anomaly and the like, the image recording apparatus is capable of maintaining the accuracy of the recorded image as high as that obtained when there is no unused linear motor mechanism.

The present invention is also intended for a recording medium transport device for transporting recording media stocked in a predetermined stocking part in an apparatus including an image recording part and for recording an image on the recording media in the image recording part.

According to the present invention, the recording medium transport device comprises: a plurality of tables for holding the recording media thereon; a supply part for supplying the recording media to each of the plurality of tables; a plurality of linear motor mechanisms for transporting the plurality of tables in a first transport section including at least an area in which the image recording part records an image on the recording media; an endless transport mechanism for transporting the plurality of tables in at least a second transport section contiguous with the first transport section and capable of transporting the plurality of tables in the first transport section; and an unused linear motor mechanism determination part for determining an unused linear motor mechanism to be unused for the transport of the plurality of tables from among the plurality of linear motor mechanisms, the plurality of linear motor mechanisms and the endless transport mechanism being provided so that the plurality of tables are used sequentially and circularly for the transport in the first transport section, wherein, when the unused linear motor mechanism is not determined, all of the plurality of linear motor mechanisms are used for the transport of the plurality of tables in the first transport section, and wherein, when the unused linear motor mechanism is determined, the endless transport mechanism is used as an alternative to transport at least one of the plurality of tables which is to be transported in the first transport section but which is able to be transported by none of the plurality of linear motor mechanisms.

If a malfunctioning linear motor mechanism is present because of a breakage, an operation anomaly and the like, continuous image recording is achieved although throughput decreases. This suppresses the reduction in productivity, as compared with the complete stop of the image recording apparatus.

Preferably, the recording medium transport device further comprises a supply timing determination part for determining supply timing indicative of when to supply the recording media from the supply part in accordance with the condition of transport of the plurality of tables, the supply timing determination part determining the supply timing so that, if an alternative transport table to be transported by the endless transport mechanism as an alternative in the first transport section is present among the plurality of tables, the recording media are not supplied from the supply part to the alternative transport table, wherein the supply part supplies the recording media to the plurality of tables, based on the supply timing determined by the supply timing determination part.

No recording medium is supplied to a table which is not transported by the linear motor mechanisms. If a malfunctioning linear motor mechanism is present because of a breakage, an operation anomaly and the like, the image recording is achieved while the accuracy of the recorded image is maintained although throughput decreases.

Preferably, the number of linear motor mechanisms provided in the recording medium transport device is greater by at least two than a simultaneous transport table count which is the number of tables included among the plurality of tables and transported at the same time in the first transport section. The plurality of linear motor mechanisms except the unused linear motor mechanism are used to transport the plurality of tables in the first transport section when the sum of the number of unused linear motor mechanisms and the simultaneous transport table count is less than the number of linear motor mechanisms provided in the recording medium transport device. The endless transport mechanism is used as an alternative for the transport only when the sum of the number of unused linear motor mechanisms and the simultaneous transport table count is not less than the number of linear motor mechanisms provided in the recording medium transport device.

If at least one of the linear motor mechanisms cannot be used for the transport because of a breakage, an operation anomaly and the like, the accuracy of the recorded image is maintained as high as that obtained when there is no unused linear motor mechanism.

It is therefore an object of the present invention to provide an image recording apparatus including a plurality of linear motor mechanisms and capable of operating without interruption if at least one of the linear motor mechanisms malfunctions, and a recording medium transport device for the image recording apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

<Overview of Construction of Image Recording Apparatus>

Figure 1:
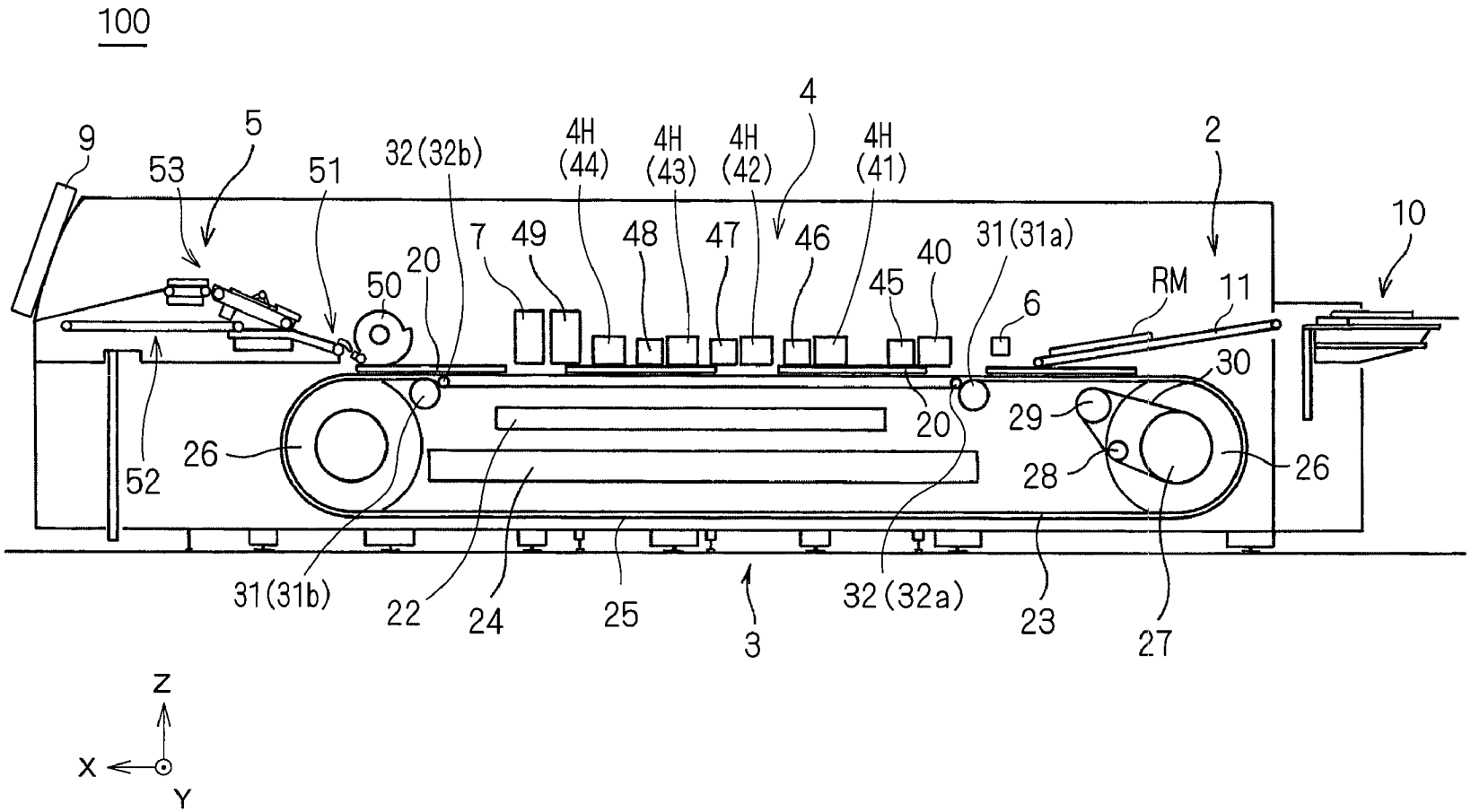
FIG. 1 is a schematic sectional view showing a mechanical construction of an image recording apparatus according to a preferred embodiment of the present invention.

FIG. 1 is a schematic sectional view principally showing a mechanical construction of a fixed head type image recording apparatus 100 for recording an image based on inkjet technology which is a form of an image recording apparatus according to a preferred embodiment of the present invention.

Figure 2:
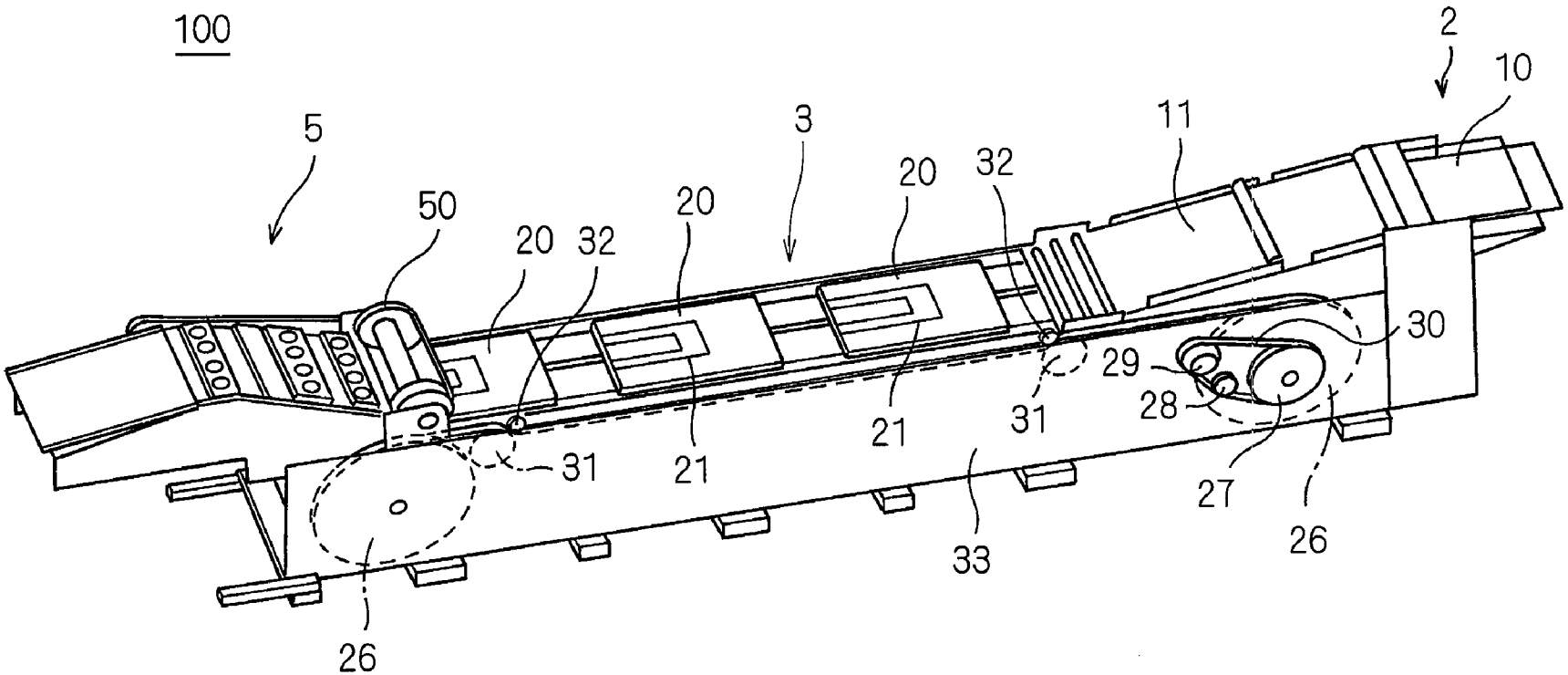
FIG. 2 is a perspective view of principal parts of the image recording apparatus of FIG. 1.

FIG. 2 is a perspective view of principal parts of the image recording apparatus 100. An XYZ rectangular coordinate system such that a direction in which recording media RM are transported is defined as the positive X direction and a vertically upward direction is defined as the positive Z direction is additionally shown in FIG. 1.

The image recording apparatus 100 is an apparatus for recording an image on the recording media RM such as, for example, printing paper and the like in accordance with descriptions of previously provided image recording data (data about color density values of pixels constituting an image to be recorded). More specifically, the image recording apparatus 100 is an inkjet printer for recording an image by ejecting inks of different colors (e.g., four colors: C (cyan), M (magenta), Y (yellow), and K (black)) corresponding to a plurality of (in FIG. 1, four) inkjet heads 4H (41 to 44), respectively, from the inkjet heads 4H toward the recording media RM. At least two of the plurality of inkjet heads 4H may eject inks of the same color (e.g., white).

An example of the recording medium RM used in this preferred embodiment includes, but is not limited to, typical printing paper (wood free paper). The recording media RM may be made of a material capable of accepting ink, such as a plastic film and the like.

The image recording apparatus 100 principally includes: a supply part 2 for supplying the recording media RM from a pre-recording stocking part 10 for stocking therein the recording media RM to be subjected to image recording; a transport mechanism 3 for transporting the recording media RM along a predetermined transport path by using ten tables 20 each capable of holding a recording medium RM thereon; an image recording part 4 for ejecting inks from a multiplicity of inkjet nozzles provided at the lower end of each of the inkjet heads 4H (41 to 44) toward the recording media RM passing through the transport path; a discharge part 5 for discharging the recording media RM with an image recorded thereon from the transport path to place the recording media RM into a post-recording stocking part (not shown); a recording medium detection sensor 6 for detecting the presence or absence of the recording media RM on the tables 20 at a predetermined position of the transport path; a scanner 7 for photoelectrically reading the image formed on the recording media RM by the image recording part 4 on the transport path; and a display and manipulation part 9 for displaying operating states and various manipulation means in the image recording apparatus 100 and for allowing an operator to perform input manipulations in accordance with the manipulation menus. The image recording apparatus 100 further includes a controller 8 for controlling the entire operations thereof (with reference to FIG. 12), although not shown in FIGS. 1 and 2.

In the image recording apparatus 100, all of the inkjet heads 4H (the head 41 for black, the head 42 for cyan, the head 43 for magenta, and the head 44 for yellow) are fixedly provided in predetermined positions. Recording of an image is achieved by ejecting inks from the plurality of inkjet nozzles provided at the lower end of each of the inkjet heads 4H in synchronism with the travel of the recording media RM directly under each of the inkjet heads 4H. The plurality of inkjet nozzles in each of the inkjet heads 4H are disposed to eject ink at equal intervals within an image recording area along the width of the recording media RM (in the Y direction as viewed in FIG. 1) toward the recording media RM transported directly thereunder so that the image is recorded on the entire surface of each of the recording media RM. As far as such a requirement is satisfied, the arrangement of the plurality of inkjet nozzles may be determined as appropriate.

In such an image recording apparatus 100, the recording media RM are previously placed on or stocked in the pre-recording stocking part 10 provided in the supply part 2. The recording media RM placed on or stocked in the pre-recording stocking part 10 are attracted one by one from the top under suction by a supply sucker 13 not shown, and are sequentially supplied to a conveyor 11. The conveyor 11 transports the supplied recording media RM sequentially to the tables 20 provided in the transport mechanism 3. In this process, a supply control part 82 to be described later controls when to attract the recording media RM under suction by means of the supply sucker 13 in consideration for the time between the supply of the recording media RM to the conveyor 11 and the transfer of the recording medium RM to the tables 20.

The ten tables 20 are arranged at fixed intervals on an endless track extending along endless guides 25 disposed on opposite side panels 33, and travels on the endless track along the guides 25. Each of the tables 20 is capable of holding a single recording medium RM thereon under suction through a suction hole 21. The recording medium RM supplied from the conveyor 11 to each of the tables 20 is transported on the transport path while being held thereon under suction through the suction hole 21. Specifically, a vacuum fan 22 is provided under the transport path of the tables 20, and exhausts air to thereby allow the recording medium RM to be held on each of the tables 20 under suction through the suction hole 21.

Figure 3:
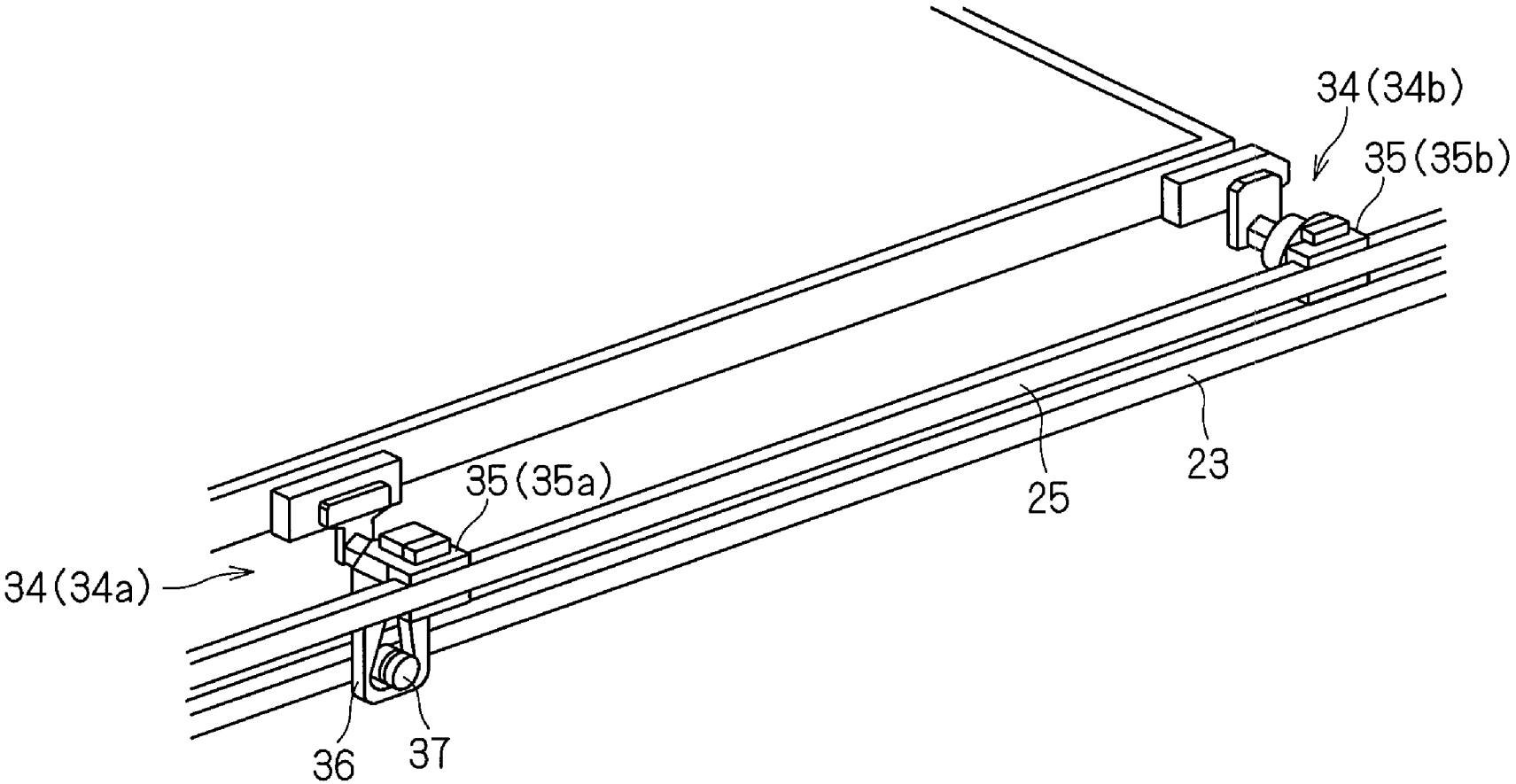
FIG. 3 is a partial perspective view showing components related to the transport of tables in a transport mechanism.
Figure 4:
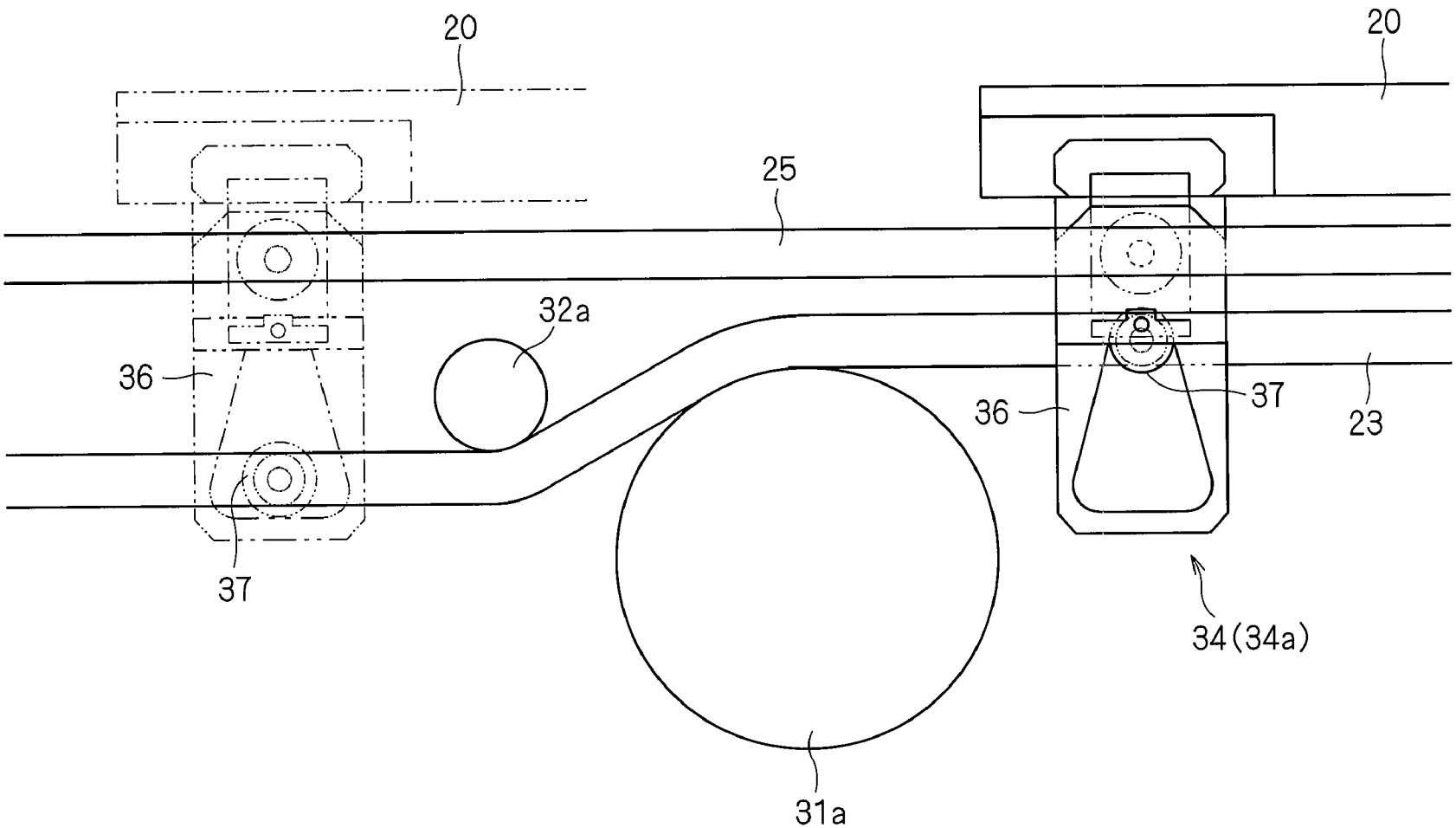
FIG. 4 is a partial view showing the coupling between the tables and a chain.

FIG. 3 is a partial perspective view showing components related to the transport of the tables 20 in the transport mechanism 3 in further detail. FIG. 4 is a partial view showing the coupling between the tables 20 and a chain 23 in further detail. More specifically, each of the plurality of tables 20 includes coupling portions 34 (first coupling portions 34*a* and second coupling portions 34*b*) at the four corners thereof. The coupling portions 34 include guide receiving portions 35 (35*a* and 35*b*), respectively, for engagement with the guides 25. The guide receiving portions 35 enable each of the tables 20 to be guided along the guides 25 and to be transported circularly in the transport mechanism 3. Of the coupling portions 34 of the tables 20, each the first coupling portions 34*a* provided at the front as viewed in the direction of the travel is provided with a chain coupling portion 36 having a generally triangular hole. The chain coupling portion 36 of each of the tables 20 is brought into engagement with a coupling pin 37 provided on the chain 23, whereby each of the tables 20 is coupled to the chain 23 looped around a pair of sprockets 26 disposed on the side panels 33 while being spaced a predetermined distance apart from the chain 23, as indicated by solid lines in FIG. 4.

As shown in FIGS. 1 and 2, a sprocket 27 is disposed on a side of one of the sprockets 26, and is coupled to a driving sprocket 28 and a driven sprocket 29 with a chain 30. The driving sprocket 28 is provided so as to be rotated by driving a motor not shown. As the motor not shown is driven, the chain 23 looped around the pair of sprockets 26 accordingly moves around to move the tables 20 along the guides 25.

The vertical position of the chain 23 is changed at some midpoint by combining a pair of sprockets 31 (31*a* and 31*b*) and a pair of sprockets 32 (32*a* and 32*b*) together. Specifically, the chain coupling portion 36 and the coupling pin 37 are decoupled from each other past a location in which the sprocket 31 a and the sprockets 32*a* are combined. The tables 20 are moved by linear motor mechanisms 24 from this location to a location in which the sprocket 31*b* and the sprocket 32*b* are combined, while being guided by the guides 25.

The linear motor mechanisms 24 are provided so as to enable a linear motor to transport the tables 20 at least during the recording of an image on the recording media RM. In this preferred embodiment, the linear motor mechanisms 24 are provided so as to be able to transport the tables 20 when the image recording part 4 records an image and when the scanner 7 reads an image. This is to enhance the accuracy of travel of the tables 20 (i.e., the accuracy of transport of the recording media RM) during the passage of the tables 20 directly under the image recording part 4 and the scanner 7. Thus, reductions are achieved in image recording errors (ejection in improper positions) in the image recording part 4 and in reading errors in the scanner 7. Specifically, a shift in the transport position of the recording media RM results in a shift in the image recording and reading positions. It is hence important to ensure the accuracy of travel of the tables 20. A section of the transport path in which the tables 20 are transported by the linear motor mechanisms 24 is also referred to hereinafter as a linear transport section. In this preferred embodiment, a maximum of three tables 20 are allowed to be present in the linear transport section at the same time.

Figure 5:
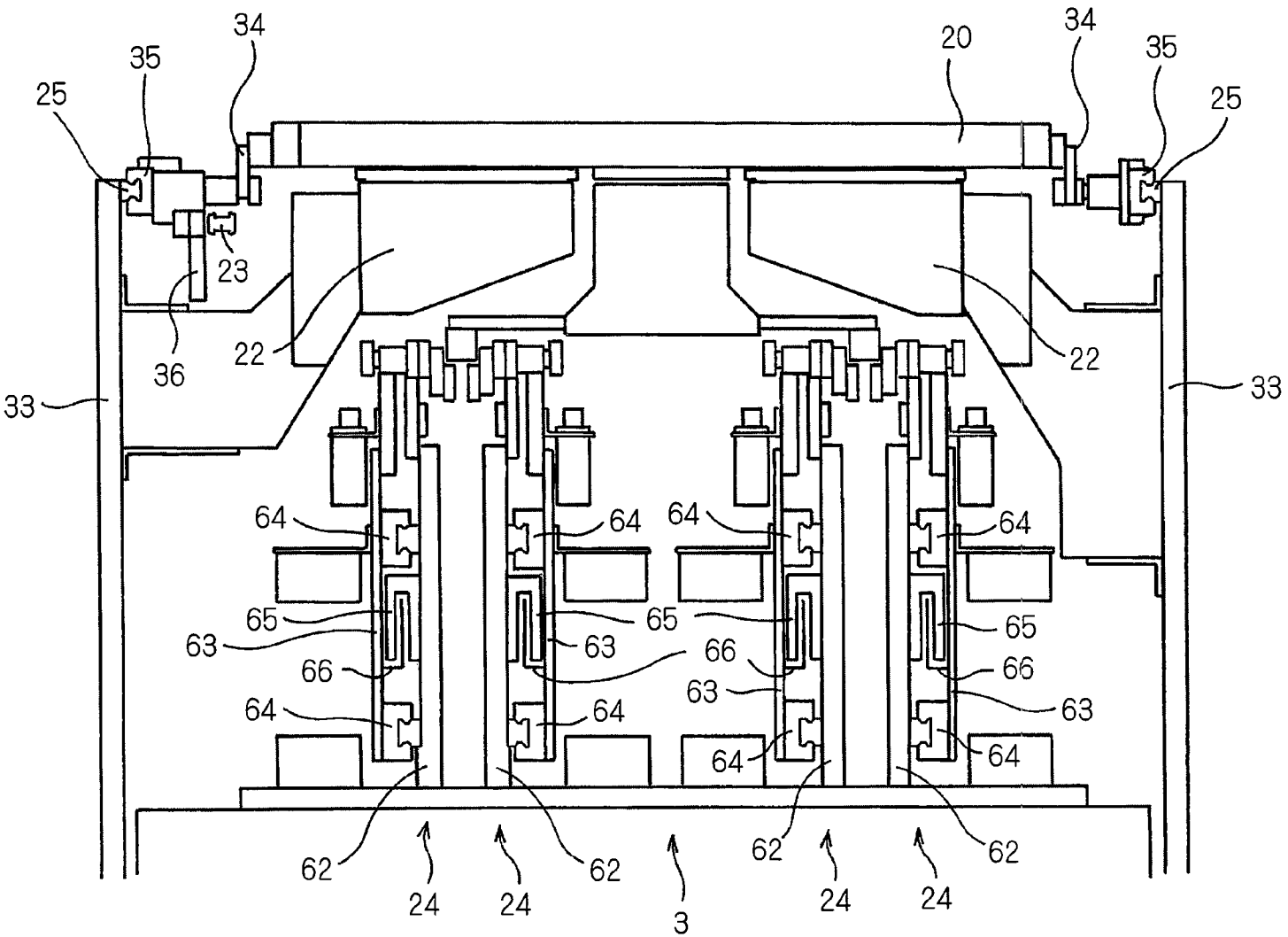
FIG. 5 is a vertical sectional view showing principal parts of the transport mechanism.

The transport mechanism 3 in the image recording apparatus 100 according to this preferred embodiment is provided with the five linear motor mechanisms 24. FIG. 5 is a vertical sectional view showing principal parts of the transport mechanism 3 and for illustrating the construction of the linear motor mechanisms 24. For purposes of illustration, only four of the five linear motor mechanisms 24 are shown in FIG. 5. The remaining linear motor mechanism 24 not shown is similar in construction to the four linear motor mechanisms 24 shown in FIG. 5. The transport mechanism 3 may be provided with more than five linear motor mechanisms 24.

Each of the linear motor mechanisms 24 includes a support plate 62 mounted upright on the main body of the image recording apparatus 100, a mobile base 63 disposed in opposed relation to the support plate 62, and a pair of linear guides 64 for coupling the mobile base 63 and the support plate 62 to each other and for horizontally movably guiding the mobile base 63 relative to the support plate 62. A stator 65 of the linear motor is fixed to the support plate 62, and a movable element 66 of the linear motor is fixed to the mobile base 63.

In each of the linear motor mechanisms 24, the mobile base 63 provided with the movable element 66 is attachable to and detachable from a table 20 under the table 20. With the mobile base 63 provided with the movable element 66 being coupled to the table 20, the mobile base 63 and the table 20 are moved by changing the magnetic polarity of the stator 65 extending in the direction of the travel of the table 20.

Each of the linear motor mechanisms 24 is provided with a movable element position detection sensor not shown for detecting where the movable element 66 is positioned in a corresponding one of the linear motor mechanisms 24.

Next, the construction of coupling mechanisms for switching the movable element 66 of a linear motor mechanism 24 and a table 20 between a coupled state and a decoupled state will be described.

Figure 6:
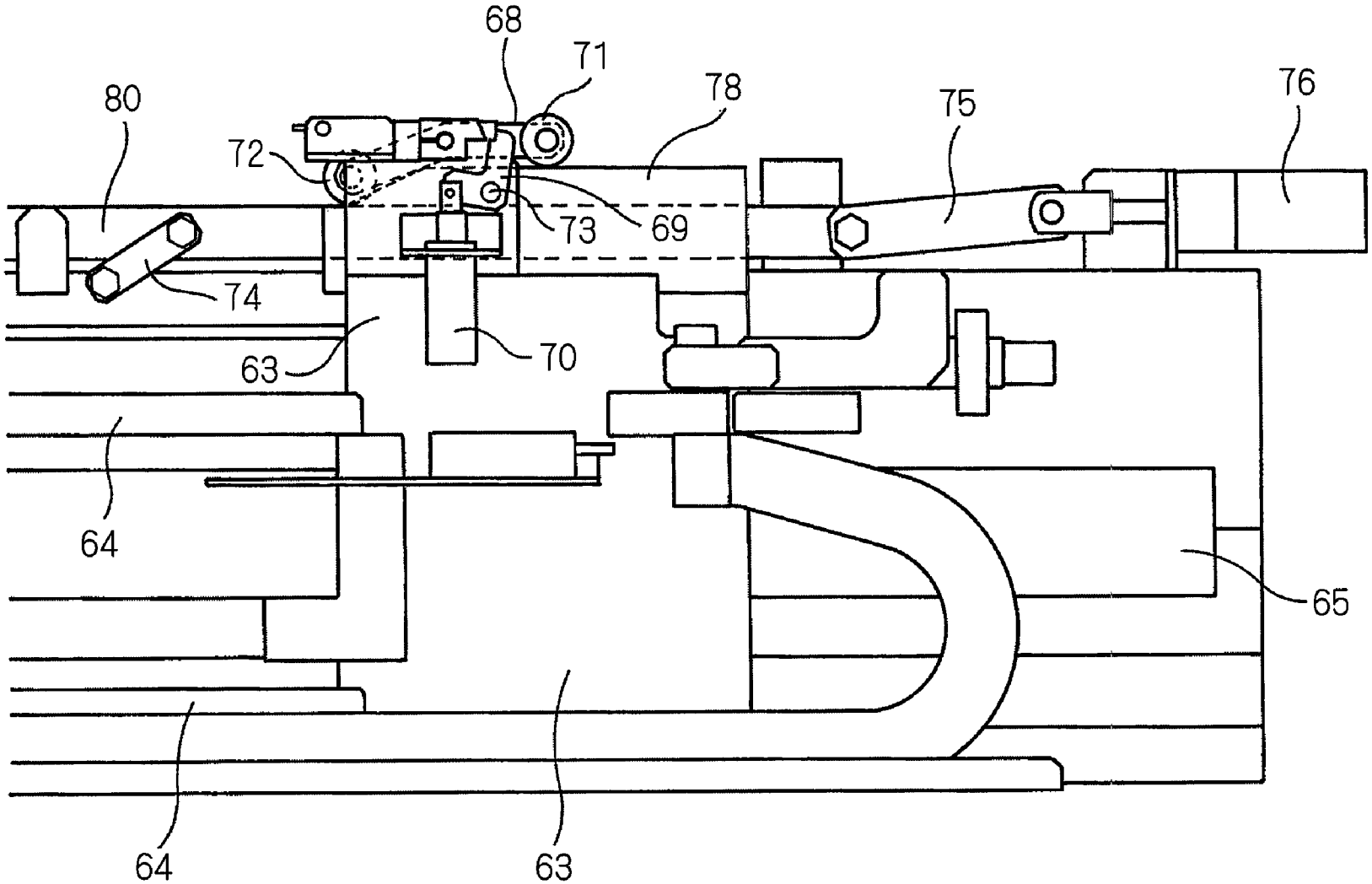
FIGS. 6 and 7 are side views showing coupling mechanisms.
Figure 7:
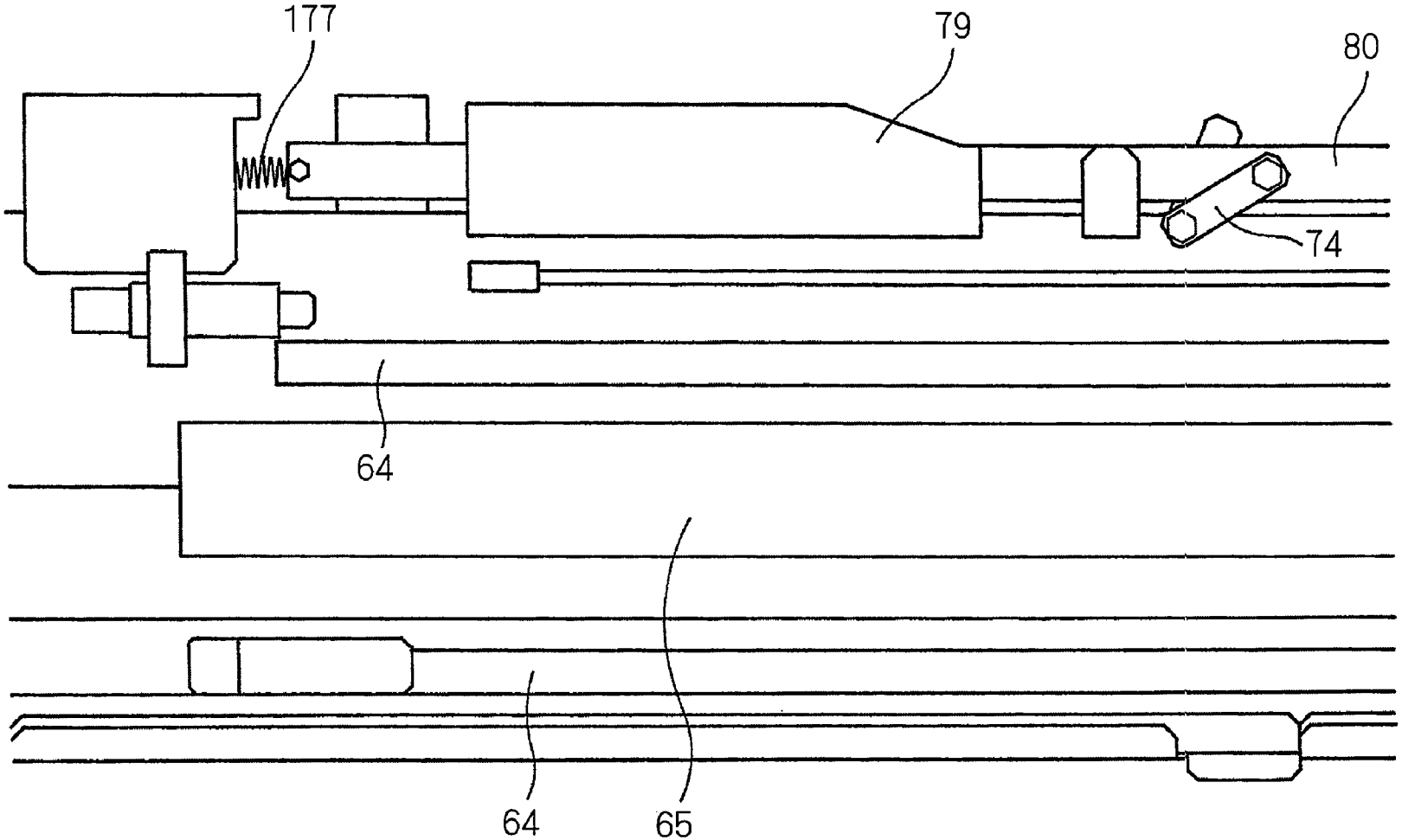

FIGS. 6 and 7 are side views showing the coupling mechanisms. FIG. 6 shows a coupling mechanism closer to the supply part 2, and FIG. 7 shows a coupling mechanism closer to the discharge part 5. FIGS. 8 to 11 are illustrations showing the coupling and decoupling operations of the coupling mechanisms.

As shown in FIGS. 8 to 11, a V-block 60 is attached to the lower surface of the table 2. A latch lever 68 pivotable about a shaft 67 is provided on the upper end of the mobile base 63 coupled to the movable element 66 of the linear motor as mentioned above. A cam follower 72 is provided on a first end of the latch lever 68. The cam follower 72 is configured to abut against a recessed portion of the V-block 60 to couple the latch lever 68 and the V-block 60 to each other. A cam follower 71 is provided on a second end of the latch lever 68. Likewise, a lock lever 69 pivotable about a shaft 73 is provided on the upper end of the mobile base 63.

As shown in FIGS. 6 and 7, a movable cam 80 extending in the direction of travel of the table 20 is provided under the above-mentioned cam follower 71. A pair of fixed cams 78 and 79 are provided on opposite ends of the movable cam 80 as viewed in the direction of the travel of the table 20.

The movable cam 80 is coupled to the main body of the image recording apparatus 100 through pivotal levers 74. The movable cam 80 has a first end coupled through a link lever 75 to an air cylinder 76. The movable cam 80 has a second end coupled through a tension spring 177 to the main body of the image recording apparatus 100. Thus, when the air cylinder 76 is driven to force the movable cam 80 leftwardly as viewed in FIGS. 6 and 7 through the link lever 75, the pivotal levers 74 are pivoted to move the movable cam 80 upwardly.

Figure 8:
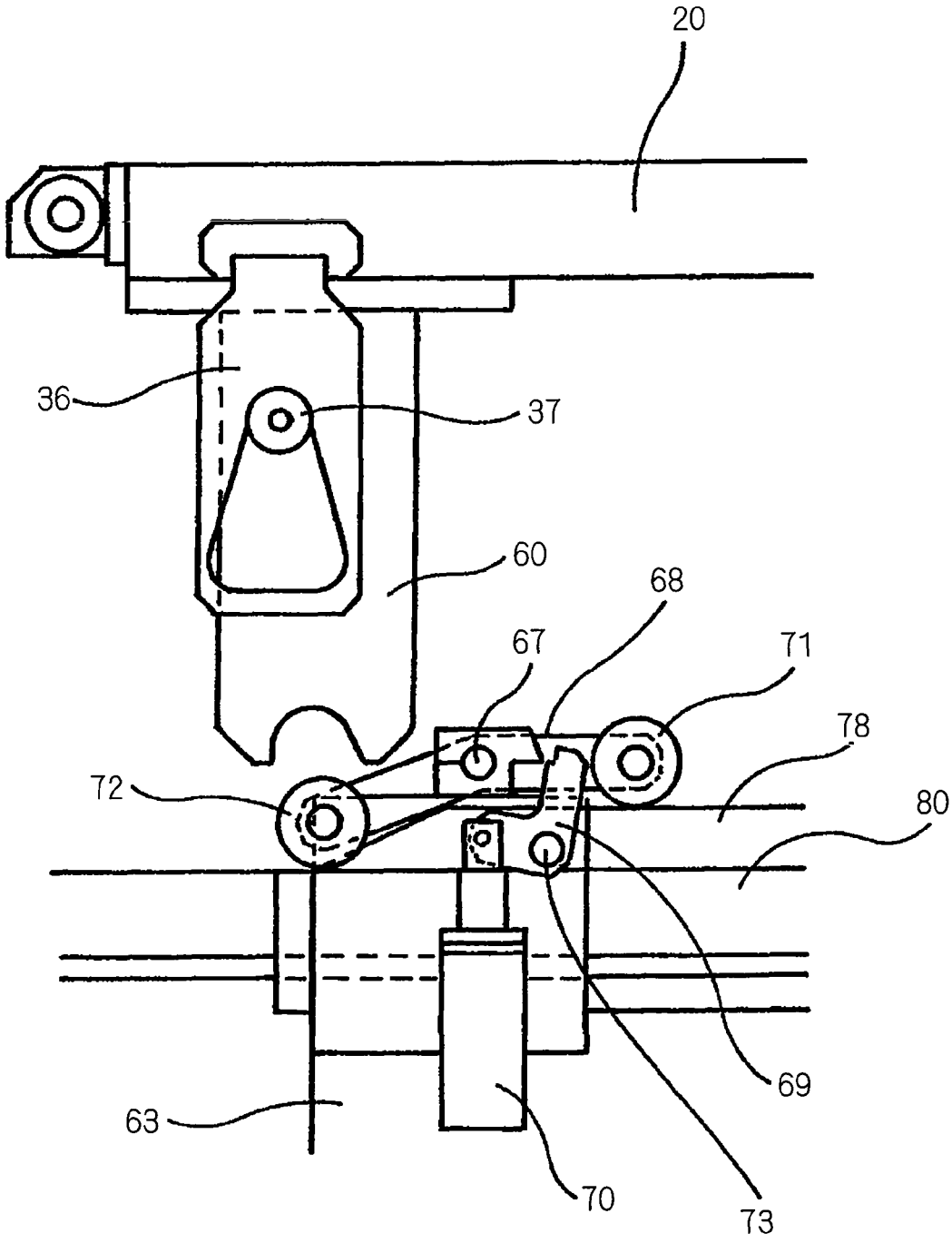
FIGS. 8 to 11 are illustrations showing the coupling and decoupling operations of the coupling mechanisms.

When the mobile base 63 is in a first end position closer to the supply part 2, the cam follower 71 rides on the fixed cam 78, and the cam follower 72 is in a lowered position, as shown in FIG. 8. In this state, when the chain 23 is driven to move the table 20 until the recessed portion of the V-block 60 comes to over the cam follower 72, the linear motor mechanism 24 is driven to cause the mobile base 63 to start moving.

Figure 9:
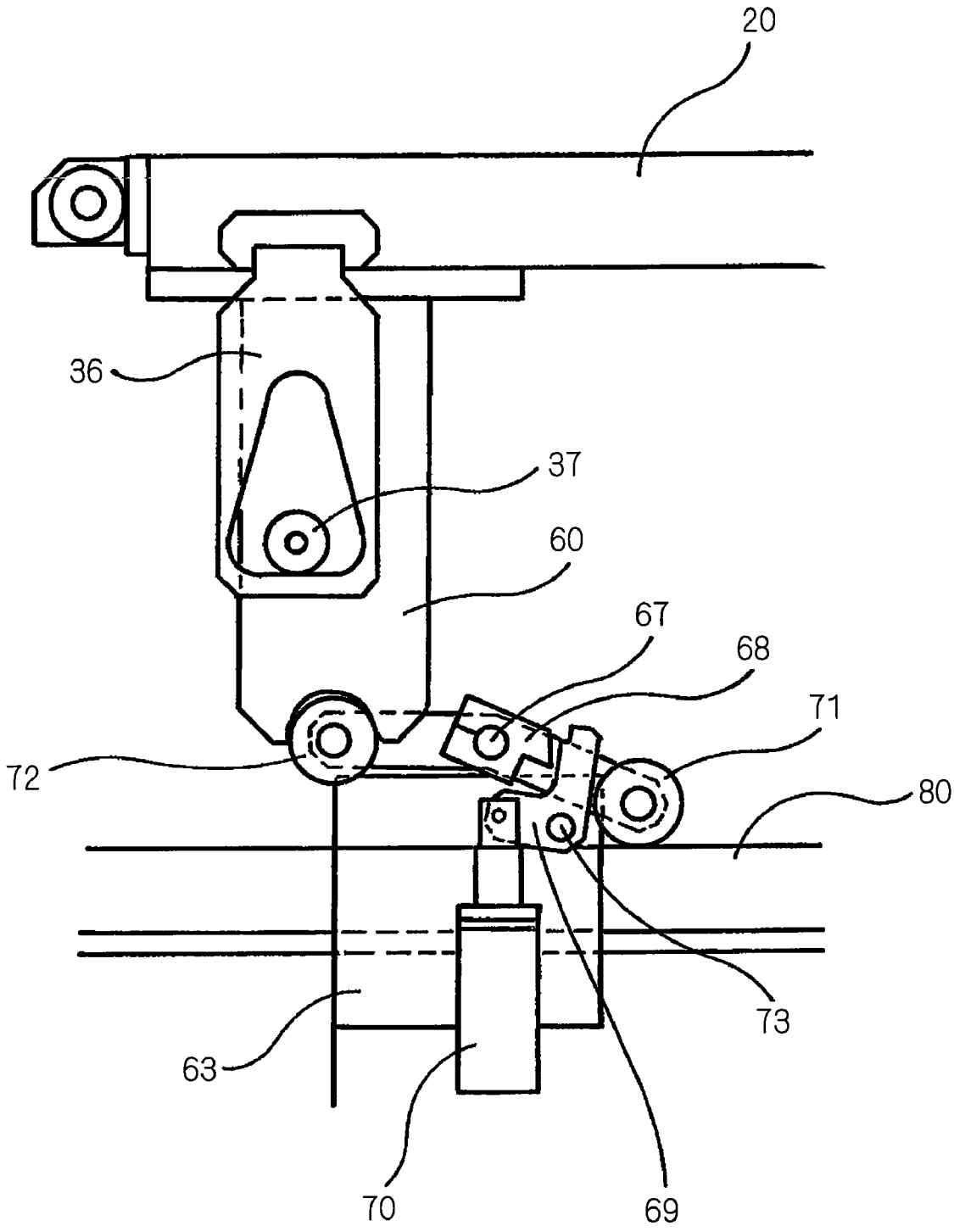

This moves the cam follower 71 from on the fixed cam 78 onto the movable cam 80, as shown in FIG. 9. Accordingly, the latch lever 68 is pivoted to bring the cam follower 72 into abutment with the recessed portion of the V-block 60, thereby coupling the cam follower 72 and the V-block 60 to each other. In this state, the table 20 and the movable element 66 of the linear motor mechanism 24 are coupled to each other. When such coupling is achieved, the table 20 is transported by the linear motor mechanism 24. Thus, the table 20 is transported in one direction with transport accuracy higher than that achieved by the chain 23.

Figure 10:
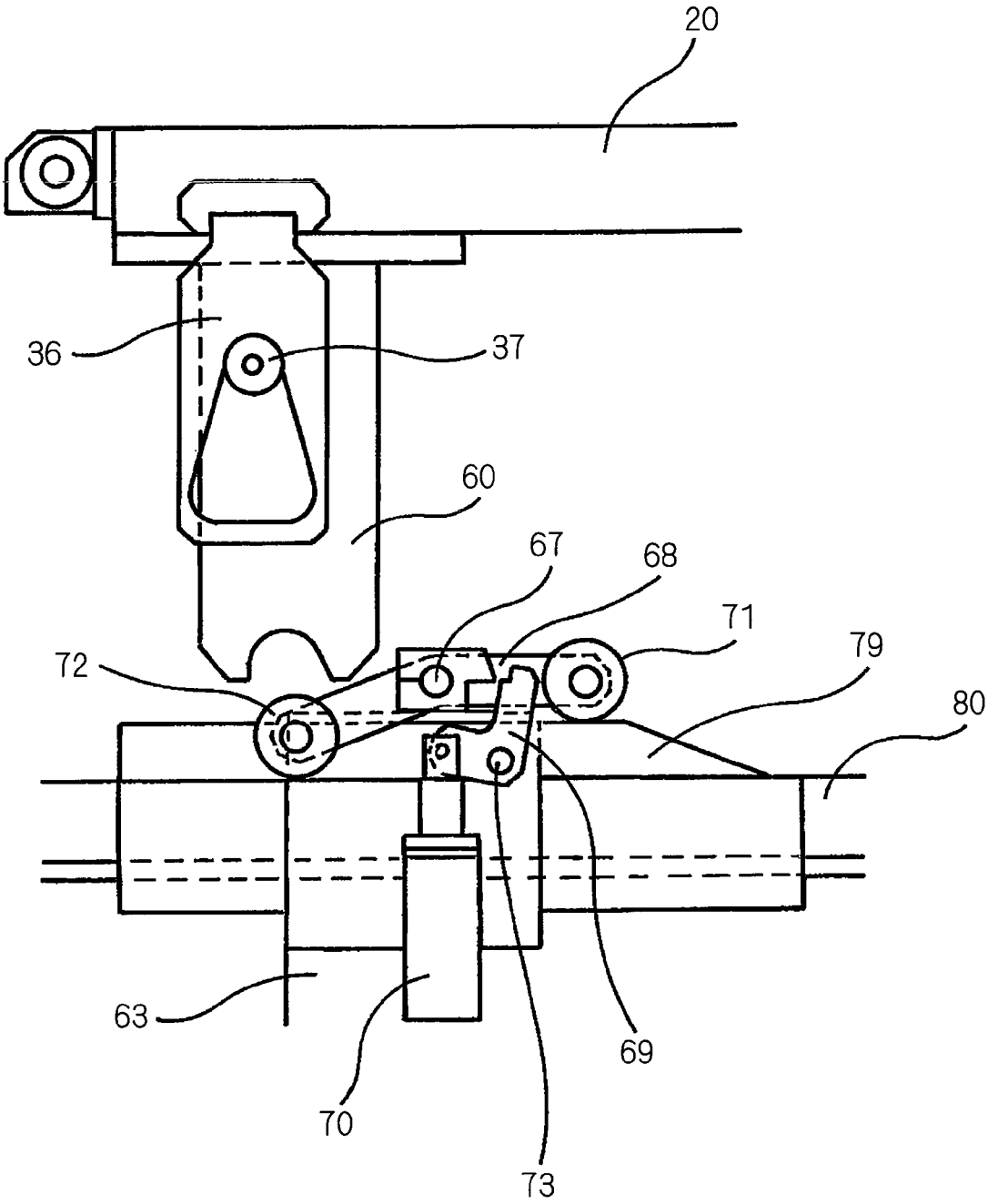

When the mobile base 63 is in a second end position closer to the discharge part 5, the cam follower 71 is moved from on the movable cam 80 onto the fixed cam 79, as shown in FIG. 10. Accordingly, the latch lever 68 is pivoted to disengage the cam follower 72 from the recessed portion of the V-block 60, thereby decoupling the cam follower 72 and the V-block 60 from each other. In this state, the table 20 and the movable element 66 of the linear motor mechanism 24 are decoupled from each other. Thereafter, the table 20 is transported again by the chain 23.

Figure 11:
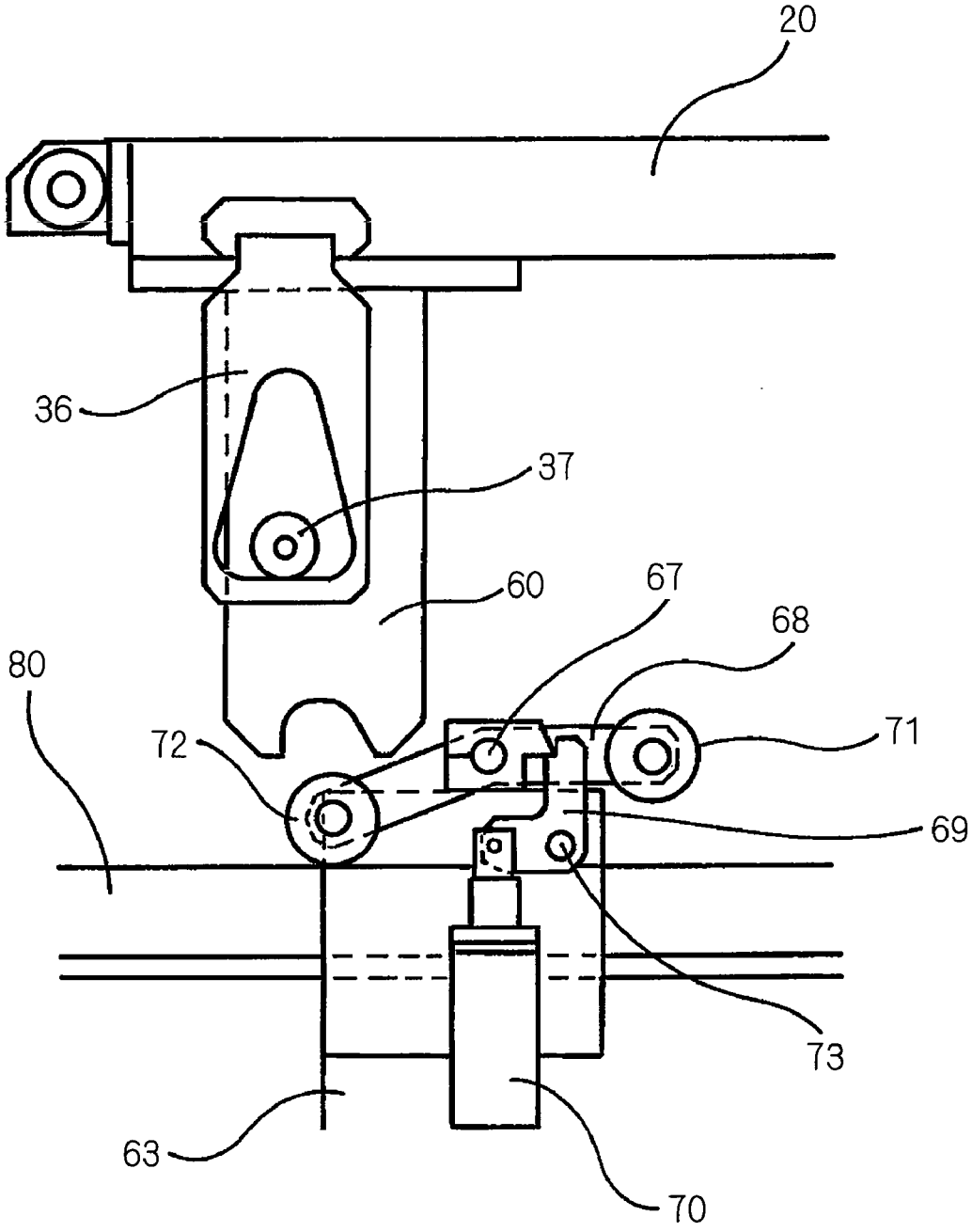

In the linear motor mechanism 24, on the other hand, the mobile base 63 returns from the second end position closer to the discharge part 5 to the first end position closer to the supply part 2. At this time, an air cylinder 70 is driven to pivot the lock lever 69 about the shaft 73, as shown in FIG. 11. Thus, the latch lever 68 is fixed in a position such that the cam follower 72 is disengaged from the V-block 60. In this state, the mobile base 63 is moved from the second end position closer to the discharge part 5 to the first end position closer to the supply part 2. At this time, since the latch lever 68 is fixed in the position where the cam follower 72 is disengaged from the V-block 60, the cam follower 72 or the like moving in a direction opposite from the direction of travel of the table 20 is prevented from interfering with the V-block 60 or the like.

After being transported by the linear motor mechanism 24, the table 20 is transported again by the chain 23. The table 20 moves to a predetermined position, and then transfers the recording medium RM held thereon under suction to the discharge part 5. Thereafter, the table 20 moves on the endless track along the guides 25, and is used again for the transport of another recording medium RM.

As described above, the image recording apparatus 100 sufficiently ensures the accuracy of the holding position of the recording media RM on the tables 20, and the transport accuracy of the tables 20 during the image recording in the image recording part 4 and during the image reading in the scanner 7.

The image recording apparatus 100 further includes a pre-processing agent ejection head 40 provided upstream from the inkjet heads 4H in the transport path and for applying a less visible (e.g., transparent) pre-processing agent prior to the ejection of ink from the inkjet heads 4H for the purpose of enhancing the fixability of ink ejected from the inkjet heads 4H. The application of such a pre-processing agent is preferable for the image recording especially on recording media RM made of a material poor in ink fixability.

The image recording apparatus 100 further includes heaters 45, 46, 47, 48 and 49 provided downstream from the pre-processing agent ejection head 40 and the inkjet heads 4H, respectively, and for blowing hot air onto the recording media RM. The heater 45 is provided for pre-heating, the heaters 46, 47 and 48 are provided for intermediate heating, and the heater 49 is provided for main heating.

The pre-processing agent ejection head 40, the inkjet heads 4H, the heaters 45 to 49 and the scanner 7 are movable by a drive mechanism not shown in a direction orthogonal to the transport direction of the recording media RM (in a direction perpendicular to the plane of FIG. 1). This enables the pre-processing agent ejection head 40, the inkjet heads 4H, the heaters 45 to 49 and the scanner 7 to reciprocatingly move between an image recording position opposed to the transport path of the recording media RM and a maintenance position not opposed to the transport path of the recording media RM. During a maintenance operation, the pre-processing agent ejection head 40, the inkjet heads 4H, the heaters 45 to 49 and the scanner 7 are moved to the maintenance position. This removes obstructions on the transport path of the recording media RM to ensure the working space for the maintenance operation of the tables 20 and the like.

The discharge part 5 includes a discharge drum 50. The discharge drum 50 separates the recording media RM from the tables 20 by winding the recording media RM around an outer peripheral portion thereof.

In the discharge part 5, an outlet passage switching mechanism 51 allow selection between the use of a first outlet passage 52 and the use of a second outlet passage 53 in accordance with a switching instruction from the controller 8. Specifically, each of the first outlet passage 52 and the second outlet passage 53 includes a conveyor. The first outlet passage 52 and the second outlet passage 53 are provided with individual stocking parts (post-recording stocking parts), respectively, for stocking the recording media RM therein. Preferably, the outlet passage switching mechanism 51 operates so that recording media RM subjected to a normal (or proper) image recording process are stocked in the stocking part through the first outlet passage 52, and other recording media RM are stocked in the stocking part through the second outlet passage 53.

The scanner 7 includes a linear CCD camera, and is adapted to photoelectrically read all or part (a patch and the like) of an image recorded on the recording media RM in response to a reading instruction from the controller 8. Typically, the scanner 7 reads an image recorded by the image recording part 4. In some cases, however, the scanner 7 reads an image without the image recording in the image recording part 4.

The display and manipulation part 9 is a display device of a touch panel type. Specifically, with various menus and the like displayed on a screen of the display and manipulation part 9, an operator touches a predetermined position of the screen to perform an input manipulation. Thus, the display and manipulation part 9 is an integral unit composed of a display part and an input manipulation part as conceptual components. Such a configuration of the display and manipulation part 9 is not essential, but the display and manipulation part 9 may be configured, for example, such that a display part such as a liquid crystal display and an input manipulation part including a plurality of key buttons are provided separately.

The recording medium detection sensor 6 is a reflective optical sensor provided downstream from the supply part 2 and upstream from the image recording part 4 over the transport path of the recording media RM, and detects whether there is a recording medium RM on each of the tables 20 or not. The recording medium detection sensor 6 directs light toward a table 20 reaching a position opposed thereto. Also, when there is no recording medium RM on the table 20, the recording medium detection sensor 6 receives light reflected from the table 20. When there is a recording medium RM on the table 20, the recording medium detection sensor 6 receives light reflected from the surface of the recording medium RM. Whether there is a recording medium RM on the table 20 or not is detected based on the amount of reflected light because the amount of reflected light differs depending on whether there is a recording medium RM on the table 20 or not. The recording medium detection sensor 6 is not particularly limited to the reflective optical sensor if the recording medium detection sensor 6 is of the type which is capable of detecting whether there is a recording medium RM on the table 20 or not.

<Details of Construction of Controller>

Figure 12:
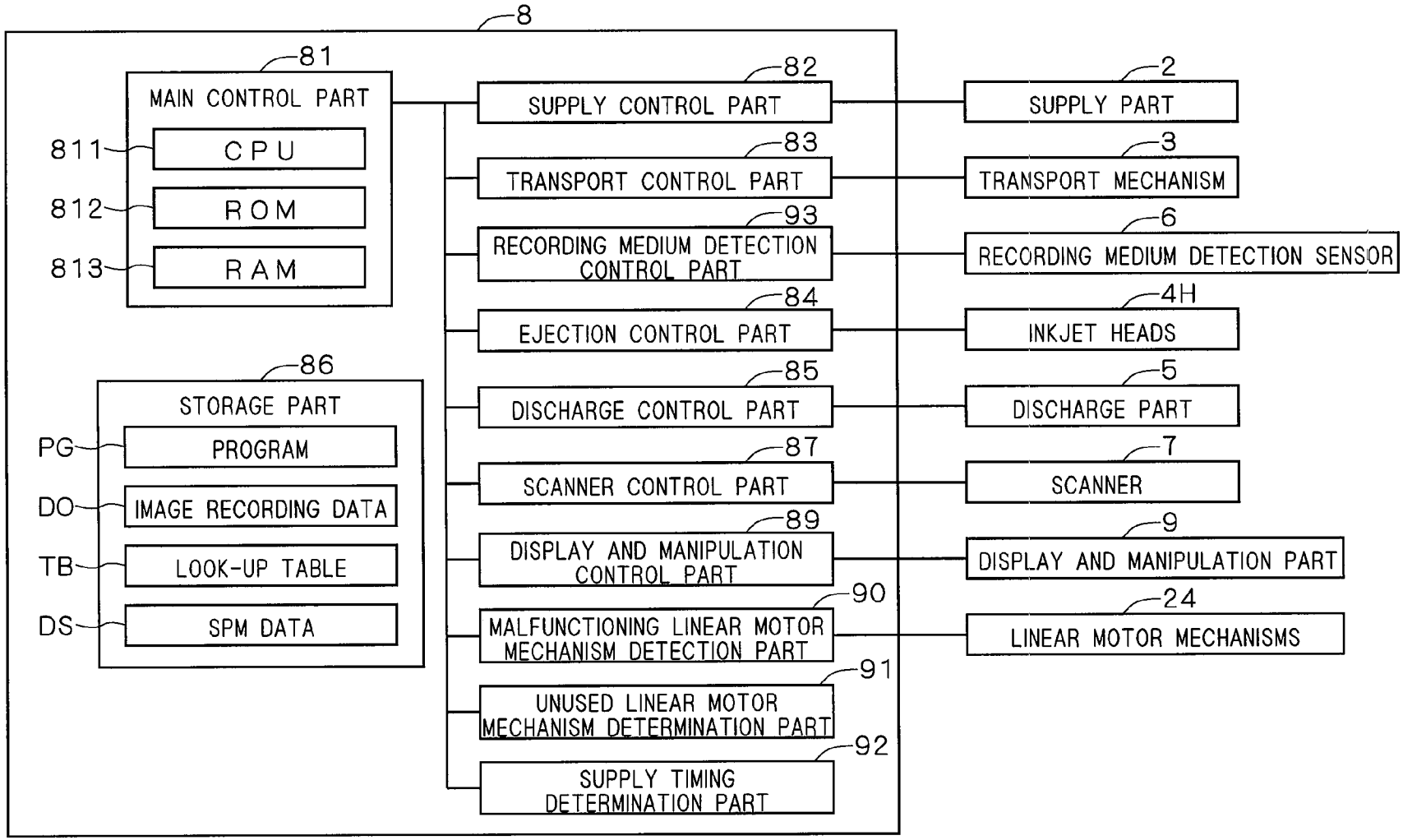
FIG. 12 is a block diagram showing the construction of a controller.

Next, the controller 8 provided in the image recording apparatus 100 will be described in detail. FIG. 12 is a block diagram showing the construction of the controller 8.

The controller 8 includes: a main control part 81 having a CPU 811, a ROM 812, a RAM 813 and the like and for effecting centralized control of the operation of the entire image recording apparatus 100 including the image recording process; the supply control part 82 for controlling the operation of the supply part 2; a transport control part 83 for controlling the operation of the transport mechanism 3; a recording medium detection control part 93 for controlling the operation of the recording medium detection sensor 6; an ejection control part 84 for controlling the operation of ejecting ink in the inkjet heads 4H (and also controlling the ejecting operation of the pre-processing agent ejection head 40 in the image recording apparatus 100); a discharge control part 85 for controlling the operation of the discharge part 5; a scanner control part 87 for controlling the operation of the scanner 7; a display and manipulation control part 89 for controlling the operation of the display and manipulation part 9; a malfunctioning linear motor mechanism detection part 90 for detecting a malfunction in the linear motor mechanisms 24; an unused linear motor mechanism determination part 91 for determining a linear motor mechanism 24 which is not to be used for the transport of the tables 20; and a supply timing determination part 92 for determining whether to provide an intermittent supply when the supply part 2 supplies the recording media RM or not and for determining when to supply the recording media RM during the intermittent supply.

The malfunctioning linear motor mechanism detection part 90 detects a malfunction in the linear motor mechanisms 24. Specifically, when a position detection sensor provided in a linear motor mechanism 24 detects the improper return of the movable element 66 to the first end position of the linear motor mechanism 24 closer to the supply part 2 or when the position of the movable element 66 in the linear motor mechanism 24 is not detected due to a failure of the position detection sensor, the malfunctioning linear motor mechanism detection part 90 detects the linear motor mechanism 24 as a malfunctioning linear motor mechanism. The malfunctioning linear motor mechanism detection part 90 may detect such a malfunction either before the image recording apparatus 100 starts the image recording process or continuously or intermittently while the image recording apparatus 100 performs the image recording process.

The unused linear motor mechanism determination part 91 serves to determine a linear motor mechanism 24 which is not to be used for the transport of the tables 20. In the unused linear motor mechanism determination part 91, a linear motor mechanism 24 detected as a malfunctioning linear motor mechanism by the malfunctioning linear motor mechanism detection part 90 is determined as the linear motor mechanism 24 which is not to be used for the transport. Additionally, if an operator recognizes a breakage of a linear motor mechanism 24 and the like, the operator may manipulate the display and manipulation part 9 to selectively specify linear motor mechanisms 24 to be used for the transport. Also, the operator may specify whether to stop driving the linear motor mechanism 24 determined as the linear motor mechanism which is not to be used for the transport or not. When the operator determines to stop driving the linear motor mechanism 24, the driving of the linear motor mechanism 24 is stopped under the control of the transport control part 83.

The supply timing determination part 92 determining whether to provide an intermittent supply such that no recording medium RM is supplied to a specific table 20 when the supply part 2 supplies the recording media RM sequentially to the plurality of tables 20. When the intermittent supply is to be provided, the supply timing determination part 92 also performs the process of specifying a table 20 to which no recording medium RM is supplied and process of determining a supply timing so that no recording medium RM is supplied to the specific table 20. The process of determining the supply timing in the supply timing determination part 92 will be described later in detail. The supply control part 82 controls the operation of the supply sucker 13 so that no recording medium RM is attracted under suction, whereby no recording medium RM is supplied to only the specific table 20.

The supply control part 82, the transport control part 83, the recording medium detection control part 93, the ejection control part 84, the discharge control part 85, the scanner control part 87, the display and manipulation control part 89, the malfunctioning linear motor mechanism detection part 90, the unused linear motor mechanism determination part 91 and the supply timing determination part 92 may be provided in the form of respective purpose-built control circuits, and may have a CPU, a ROM, a RAM and the like in a manner similar to the main control part 81. Further, the main control part 81 may also have the functions of the respective control parts.

The controller 8 further includes a storage part 86 composed of, for example, a hard disk and the like. The storage part 86 stores therein a program PG executed in the CPU 811 to thereby perform various functions in the main control part 81, and various data related to the operation of the image recording apparatus 100. Examples of the data stored in the storage part 86 include image recording data D0 about descriptions of recording (color density values for respective pixel positions (XY addresses) described based on a CMYK color system) of an image to be recorded, a look-up table TB containing descriptions about a relationship (a tone reproduction curve) between the color density values and the amount of ink ejection for the individual inkjet nozzles, and SPM (screen pattern memory) data DS specifying how to eject ink to form pixels having a given color density value. The image recording data DO may be held in the RAM 813.

<Detailed Description of Transport of Tables by Linear Motor Mechanisms>

Next, the transport of the ten tables 20 by using the linear motor mechanisms 24 will be described in detail. FIGS. 13 to 21 are schematic diagrams of the linear transport section in the image recording apparatus 100 as viewed in the positive Z direction of FIG. 1 for the purpose of illustrating the transport of the ten tables 20 by using the linear motor mechanisms 24. The direction of travel of the tables 20 in the linear transport section, i.e. the direction of transport of the recording media RM, is leftward, i.e. from right to left, as viewed in FIGS. 13 to 21.

With reference to FIGS. 13 to 21, reference numerals 24*a*, 24*b*, 24*c*, 24*d* and 24*e* are used to make a distinction between the five linear motor mechanisms 24, and the linear motor mechanisms 24*a*, 24*b*, 24*c*, 24*d* and 24*e* shall be arranged in the order named in the negative Y direction of FIG. 1. Reference numerals 66*a* to 66*e* are used to designate the movable elements of the respective linear motor mechanisms 24*a* to 24*e*, and the movable elements 66*a* to 66*e* are schematically shown in FIGS. 13 to 21. Arrows in FIGS. 13 to 21 denote the direction of the movement of the movable elements 66*a* to 66*e*. Reference numerals 20*a* to 20*j* are used to make a distinction between the ten tables 20. The table 20*a* is the table transported for the first time from a first end position of the linear transport section closer to the supply part 2 (the right-hand end position of the linear motor mechanisms 24*a* to 24*e* as viewed in FIGS. 13 to 21) to a second end position thereof closer to the discharge part 5 (the left-hand end position of the linear motor mechanisms 24*a* to 24*e* as viewed in FIGS. 13 to 21). The tables 20*b*, 20*c*, 20*d*, . . . and 20*j* are the tables 20 transported following the table 20*a* to the second end position in the order named. Following the table 20*j*, the table 20*a* transported by the chain 23 along the endless track after the transport in the linear transport section reaches the first end position of the linear transport section closer to the supply part 2 again.

Figure 13:
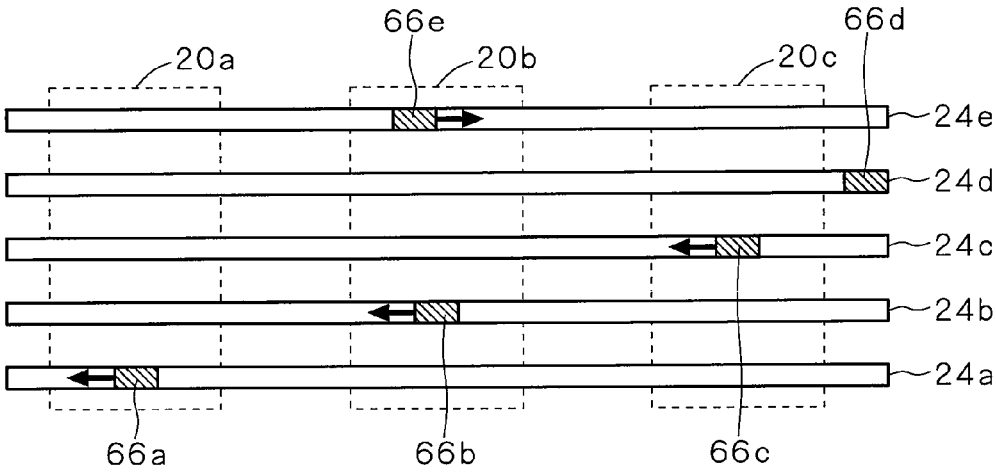
FIGS. 13 to 15 are diagrams for illustration of the transport of ten tables by using five linear motor mechanisms.
Figure 14:
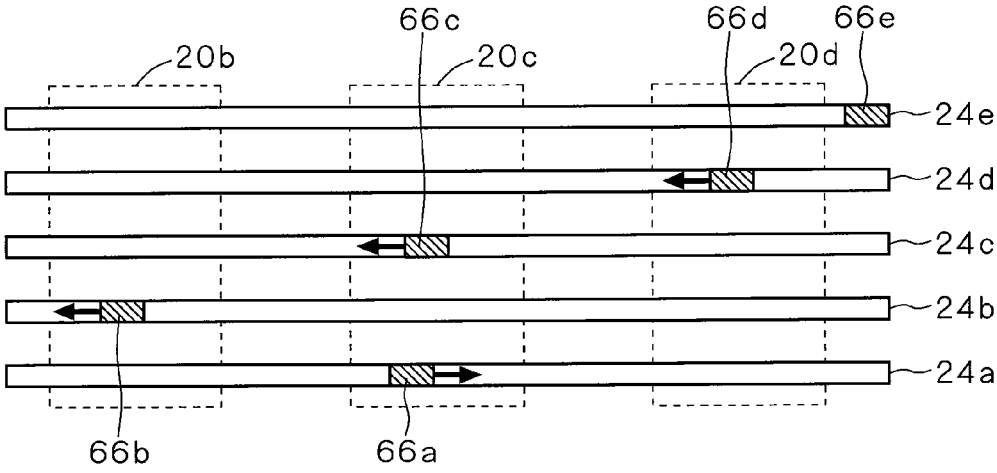
Figure 15:
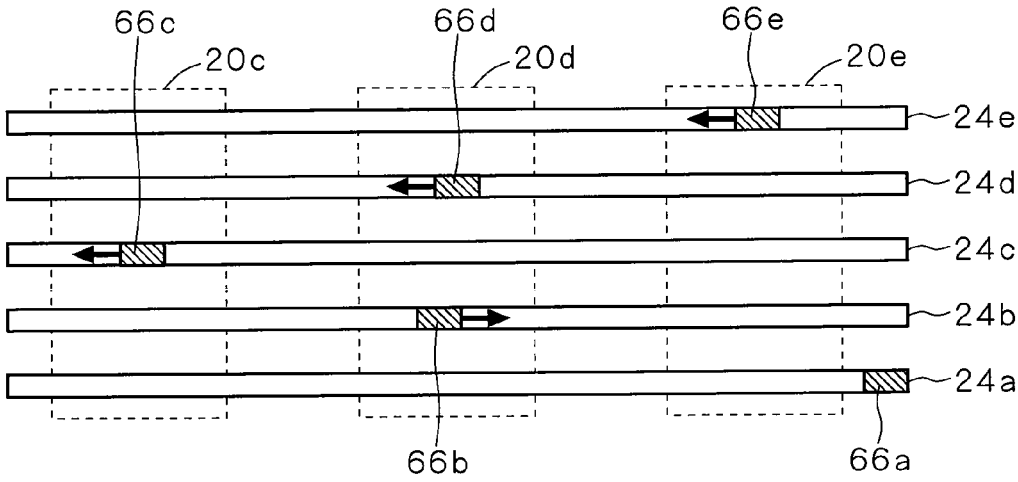

FIGS. 13 to 15 are diagrams for illustration of the transport of the ten tables 20*a* to 20*j* by using the five linear motor mechanisms 24*a* to 24*e*. This corresponds to an instance (a first case) in which no linear motor mechanisms 24 are determined by the unused linear motor mechanism determination part 91.

With reference to FIG. 13, the tables 20*a*, 20*b* and 20*c* are shown as coupled to the movable elements 66*a*, 66*b* and 66*c*, respectively, and transported from right to left as viewed in the figure. The movable element 66*d* is in a standby condition in the first end position of the linear transport section closer to the supply part 2, pending the table 20*d* to be transported next to the linear transport section by the linear motor mechanisms 24. The movable element 66*e* is moving, after finishing the transport of the table 20*j* having been executed immediately before the transport of the table 20*a* by the linear motor mechanisms 24, to return from the second end position of the linear motor mechanism 24*e* closer to the discharge part 5 to the first end position thereof closer to the supply part 2.

FIG. 14 is a diagram showing the linear transport section after the movable element 66*a* finishes the transport of the table 20*a* with reference to FIG. 13. The tables 20*b*, 20*c* and

20*d* are shown as coupled to the movable elements 66*b*, 66*c* and 66*d*, respectively, and transported in the order named as viewed from the second end position of the linear transport section closer to the discharge part 5. The movable element 66*a* is moving to return to the first end position of the linear motor mechanism 24*a* closer to the supply part 2 after finishing the transport of the table 20*a*. The movable element 66*e* is in a standby condition in the first end position of the linear motor mechanism 24*e* closer to the supply part 2 pending the table 20*e* to be transported next.

FIG. 15 is a diagram showing the linear transport section after the movable element 66*b* finishes the transport of the table 20*b* with reference to FIG. 14. The tables 20*c*, 20*d* and 20*e* are shown as coupled to the movable elements 66*c*, 66*d* and 66*e*, respectively, and transported in the order named as viewed from the second end position of the linear transport section closer to the discharge part 5. The movable element 66*b* is moving to return to the first end position of the linear motor mechanism 24*b* closer to the supply part 2 after finishing the transport of the table 20*b*. The movable element 66*a* is in a standby condition in the first end position of the linear motor mechanism 24*a* closer to the supply part 2 pending the table 20*f* to be transported next.

In the first case as described above, the five linear motor mechanisms 24*a* to 24*e* are used to transport the tables 20*a* to 20*j* sequentially to the linear transport section.

Figure 16:
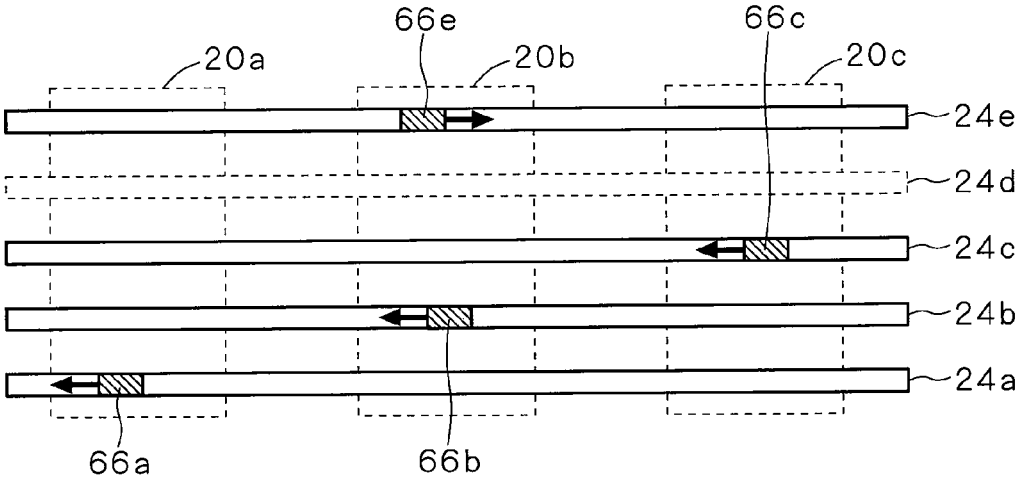
FIGS. 16 to 18 are diagrams for illustration of the transport of the ten tables by using four of the five linear motor mechanisms.
Figure 17:
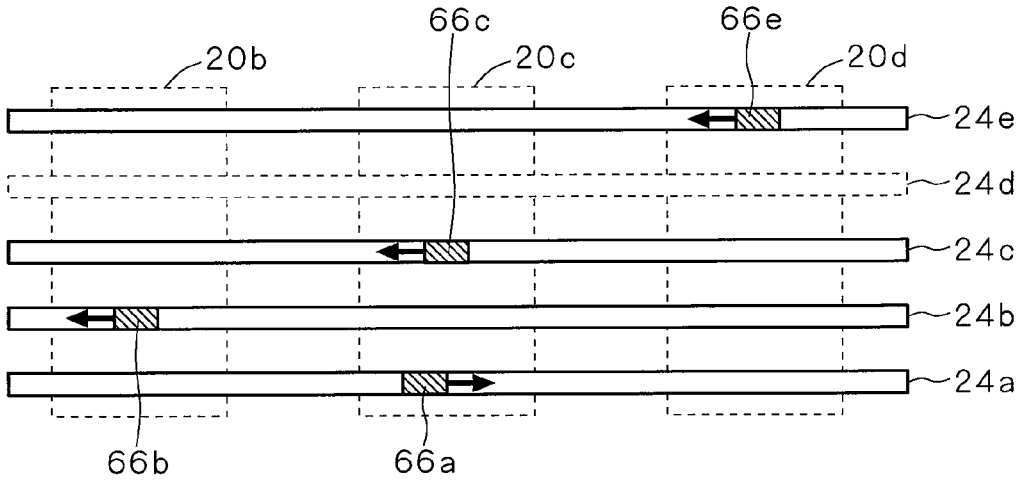
Figure 18:
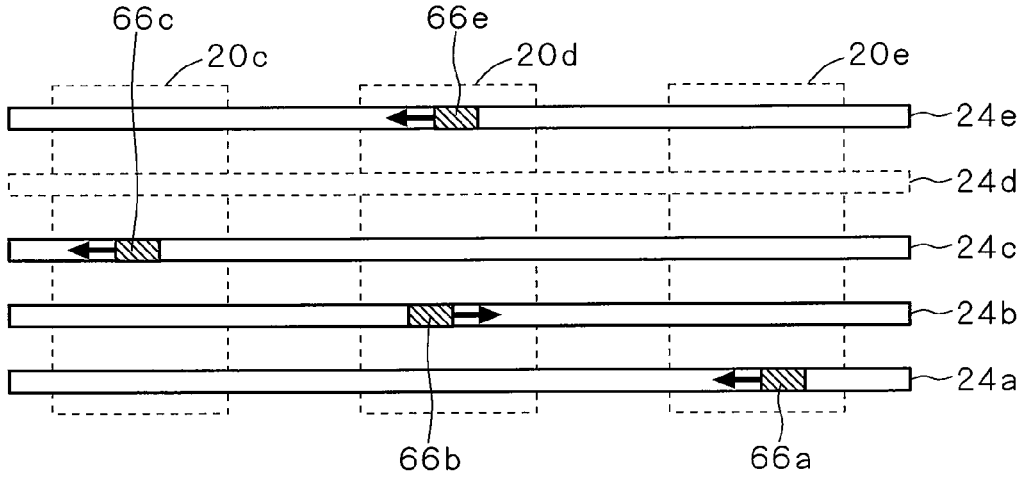

FIGS. 16 to 18 are diagrams for illustration of the transport of the ten tables 20*a* to 20*j* when, because one linear motor mechanism 24*d* included among the five linear motor mechanisms 24*a* to 24*e* malfunctions or for other reasons, the remaining four linear motor mechanisms 24 are used for the transport. In other words, FIGS. 16 to 18 are diagrams illustrating an instance in which the linear motor mechanism 24*d* is determined to be unused for the transport by the unused linear motor mechanism determination part 91. This corresponds to an instance (a second case) in which the sum of the number of linear motor mechanisms 24 determined to be unused (in this case, one) and the number of tables transported at the same time (in this case, three) is less than the number of linear motor mechanisms 24 provided in the image recording apparatus 100 (in this case, five).

With reference to FIG. 16, the tables 20*a*, 20*b* and 20*c* are shown as coupled to the movable elements 66*a*, 66*b* and 66*c*, respectively, and transported from right to left as viewed in the figure. The movable element 66*e* is moving, after finishing the transport of the table 20*j* having been executed immediately before the transport of the table 20*a* by the linear motor mechanisms 24, to return from the second end position of the linear motor mechanism 24*e* closer to the discharge part 5 to the first end position thereof closer to the supply part 2. The movable element 66*d* (and the linear motor mechanism 24*d*) is not used for the transport, as mentioned above.

FIG. 17 is a diagram showing the linear transport section after the movable element 66*a* finishes the transport of the table 20*a* with reference to FIG. 16. The tables 20*b* and 20*c* are shown as coupled to the movable elements 66*b* and 66*c*, respectively, and transported in the order named as viewed from the second end position of the linear transport section closer to the discharge part 5. Since the linear motor mechanism 24*d* is determined to be unused by the unused linear motor mechanism determination part 91, the table 20*d* is coupled to the movable element 66*e* provided in the linear motor mechanism 24*e* and transported thereby. The movable element 66*a* is moving to return to the first end position of the linear motor mechanism 24*a* closer to the supply part 2 after finishing the transport of the table 20*a*.

FIG. 18 is a diagram showing the linear transport section after the movable element 66*b* finishes the transport of the table 20*b* with reference to FIG. 17. The tables 20*c*, 20*d* and 20*e* are shown as coupled to the movable elements 66*c*, 66*e* and 66*a*, respectively, and transported in the order named as viewed from the second end position of the linear transport section closer to the discharge part 5. The movable element 66*b* is moving to return to the first end position of the linear motor mechanism 24*b* closer to the supply part 2 after finishing the transport of the table 20*b*.

As described above, the second case provides a throughput similar to that of the first case to achieve the image recording although the linear motor mechanism 24 determined to be unused is present.

Figure 19:
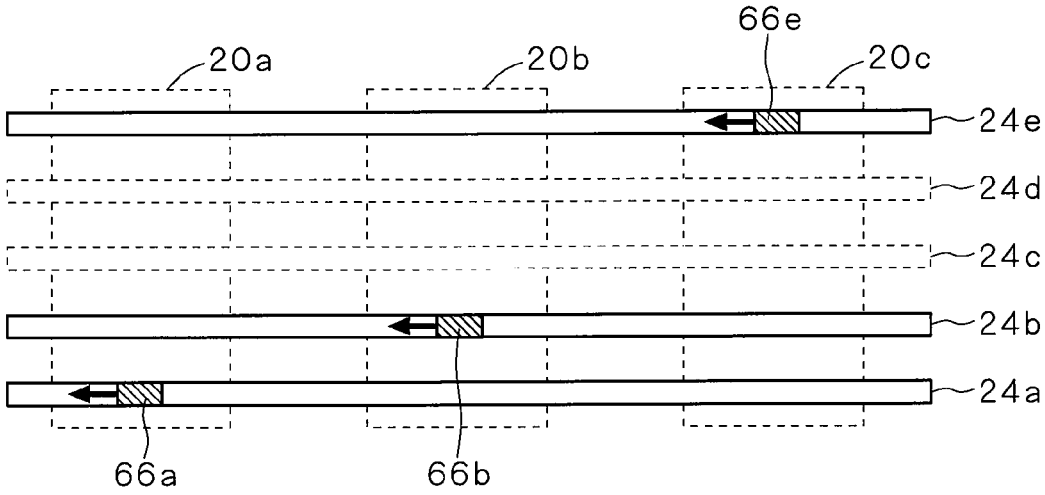
FIGS. 19 to 21 are diagrams for illustration of the transport of the ten tables by using three of the five linear motor mechanisms.
Figure 20:
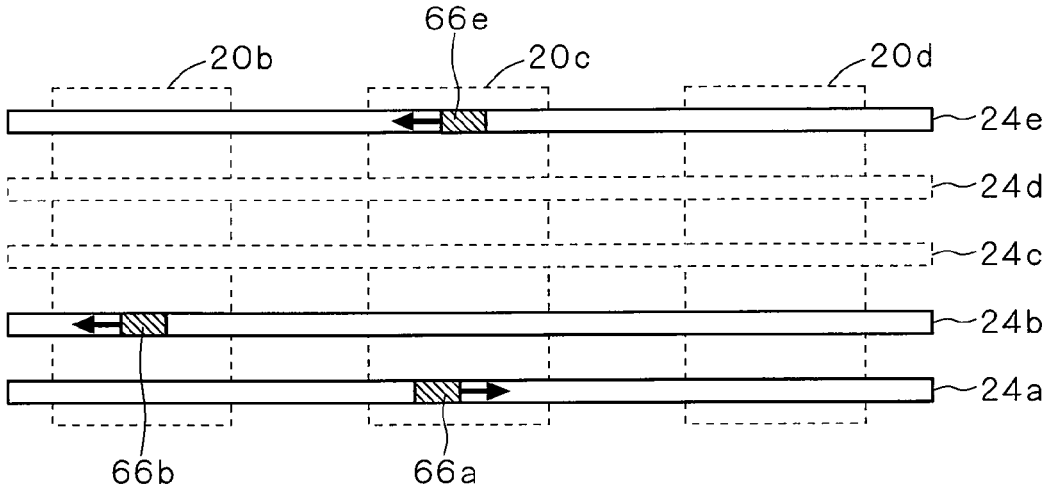
Figure 21:
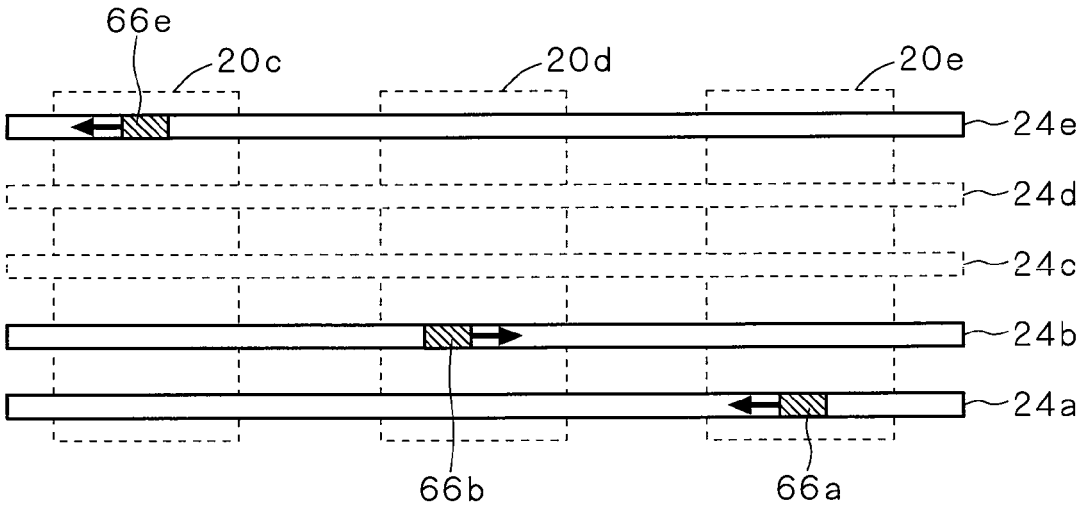

FIGS. 19 to 21 are diagrams for illustration of the transport of the ten tables 20*a* to 20*j* when, because two linear motor mechanisms 24*c* and 24*d* included among the five linear motor mechanisms 24*a* to 24*e* malfunction or for other reasons, the remaining three linear motor mechanisms 24 are used for the transport. In other words, FIGS. 19 to 21 are diagrams illustrating an instance in which the linear motor mechanisms 24*c* and 24*d* are determined to be unused for the transport by the unused linear motor mechanism determination part 91. This corresponds to an instance (a third case) in which the sum of the number of linear motor mechanisms 24 determined to be unused (in this case, two) and the number of tables transported at the same time (in this case, three) is equal to the number of linear motor mechanisms 24 provided in the image recording apparatus 100 (in this case, five).

With reference to FIG. 19, the tables 20*a*, 20*b* and 20*c* are shown as coupled to the movable elements 66*a*, 66*b* and 66*e*, respectively, and transported from right to left as viewed in the figure. The movable element 66*c* (and the linear motor mechanism 24*c*) and the movable element 66*d* (and the linear motor mechanism 24*d*) are not used for the transport, as mentioned above. In the case shown in FIG. 19, there is neither movable element 66 moving to return nor movable element 66 in a standby condition.

FIG. 20 is a diagram showing the linear transport section after the movable element 66*a* finishes the transport of the table 20*a* with reference to FIG. 19. The tables 20*b* and 20*c* are shown as coupled to the movable elements 66*b* and 66*e*, respectively, and transported in the order named as viewed from the second end position of the linear transport section closer to the discharge part 5. The movable element 66*a* is moving to return to the first end position of the linear motor mechanism 24*a* closer to the supply part 2 after finishing the transport of the table 20*a*. Thus, at this point, there is no linear motor mechanism 24 that is able to transport the table 20*d*. In such a case, the chain 23 is used in place of the linear motor mechanisms 24 to transport the table 20*d* in this preferred embodiment. Thus, the chain 23 is used as an alternative to transport a table 20 which cannot be transported by the linear motor mechanisms 24 in the linear transport section because of the presence of the linear motor mechanism 24 determined to be unused.

FIG. 21 is a diagram showing the linear transport section after the movable element 66*b* finishes the transport of the table 20*b* with reference to FIG. 20. The tables 20*c* and 20*e* are shown as coupled to the movable elements 66*e* and 66*a*, respectively, and transported in the order named as viewed from the second end position of the linear transport section closer to the discharge part 5. The table 20*d* is shown as transported by the chain 23. The movable element 66*b* is moving to return to the first end position of the linear motor mechanism 24*b* closer to the supply part 2 after finishing the transport of the table 20*b*.

In the third case as described above, one of the tables 20 is required to be transported before any of the movable elements 66 returns. In such a case, this table 20 is not transported by the linear motor mechanisms 24, but the chain 23 is used as an alternative to transport this table 20.

By way of amplification of the first to third cases described above, the image recording apparatus 100 according to this preferred embodiment is adapted to transport the table 20 in a manner to be described below. When the sum (x+y) of the number (x) of linear motor mechanisms 24 determined to be unused and the number (y) of tables 20 transported at the same time in the linear transport section is less than the number (z) of linear motor mechanisms 24 provided in the image recording apparatus 100, the linear motor mechanisms 24 except the linear motor mechanism(s) 24 determined to be unused are used to transport the tables 20. When the above-mentioned sum (x+y) is not less than the number (z) of linear motor mechanisms 24 provided in the image recording apparatus 100, the chain 23 is used as an alternative for the transport.

This prevents the entire image recording apparatus 100 from becoming immediately unusable if there is a linear motor mechanism determined to be unused because of a breakage, an operation anomaly and the like, to allow the continuous image recording although the throughput thereof decreases. Thus, this preferred embodiment suppresses the reduction in productivity, as compared with the complete stop of the image recording apparatus 100.

From another point of view, setting the number (z) of linear motor mechanisms 24 provided in the image recording apparatus 100 greater by two than the number (y) of tables 20 transported at the same time in the linear transport section eliminates the need to use the chain 23 as an alternative for the transport until the above-mentioned sum (x+y) becomes equal to the number (z) of linear motor mechanisms 24 provided in the image recording apparatus 100 if there is a linear motor mechanism 24 determined to be unused.

<Supply Timing of Recording Media RM>

Next, the supply timing of the recording media RM from the supply part 2 will be described in detail. For example, when there is a table 20 which cannot be transported by the linear motor mechanisms 24 but is required to be transported by the chain 23 in the linear transport section as in the third case mentioned above, the image recording on a recording medium RM transported by this table 20 provides insufficient image recording accuracy. Thus, the image recording apparatus 100 is adapted so that no recording medium RM is supplied from the supply part 2 to the table 20 transported by the chain 23 as an alternative. In other words, the intermittent supply of the recording media RM is provided.

Figure 22:
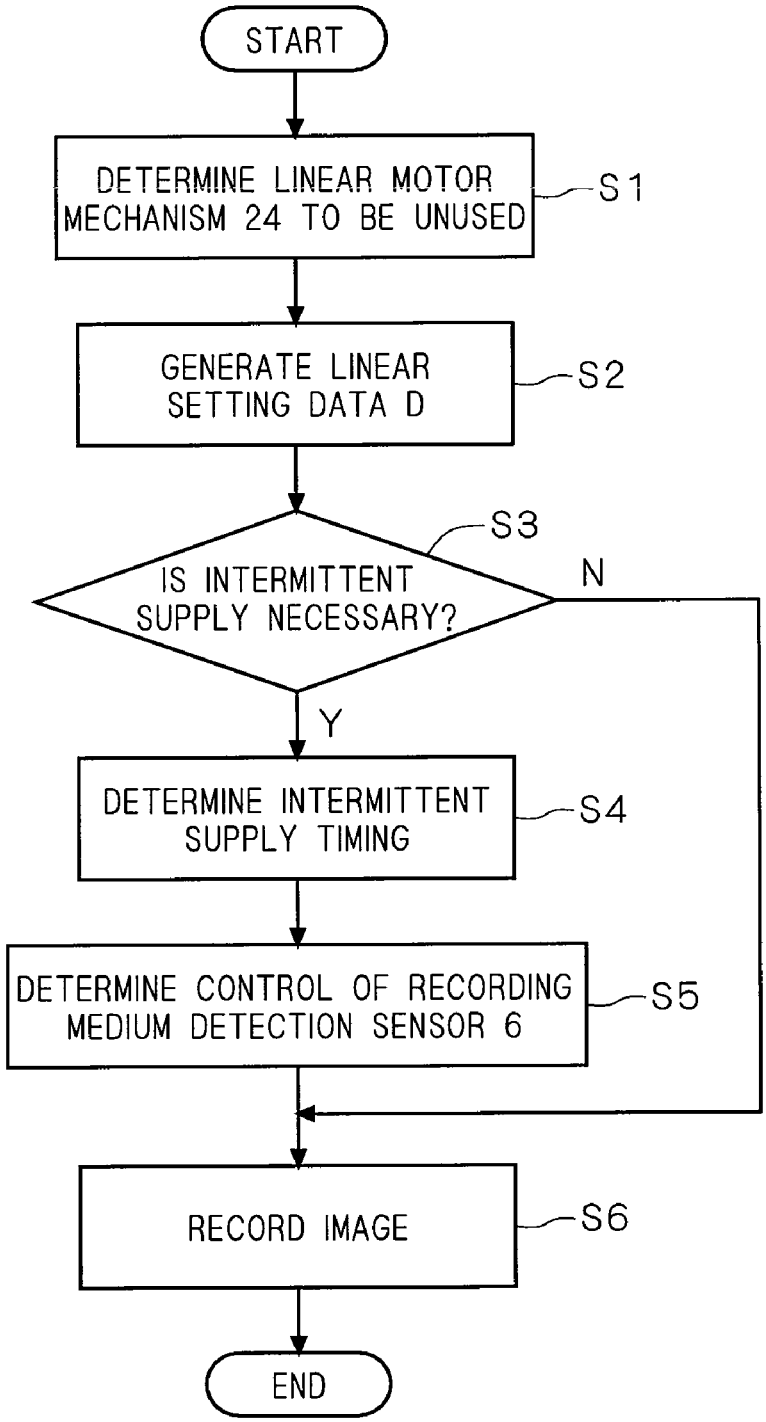
FIG. 22 is a flow diagram showing the process of determining the supply timing of recording media.

FIG. 22 is a flow diagram showing the process of determining the supply timing of the recording media RM, i.e. when to supply the recording media RM, from the supply part 2. First, the unused linear motor mechanism determination part 91 determines a linear motor mechanism 24 to be unused for the transport (in Step S1). As mentioned above, the linear motor mechanism 24 determined to be unused includes a linear motor mechanism 24 specified arbitrarily by an operator in addition to a linear motor mechanism 24 detected by the malfunctioning linear motor mechanism detection part 90 as a malfunctioning linear motor mechanism.

Subsequently, linear setting data D about descriptions of information indicating whether each of the linear motor mechanisms 24*a* to 24*e* is to be used for the transport or not is generated in the unused linear motor mechanism determination part 91 (in Step S2). Specifically, the linear setting data D is 5-bit data composed of five 1-bit data Da, Db, Dc, Dd and De each taking a value of "0" or "1" and indicated in the form of D=(Da, Db, Dc, Dd, De).

The 1-bit data Da to De are those corresponding to the linear motor mechanisms 24*a* to 24*e*, respectively. When each of the linear motor mechanisms 24 is determined to be unused, the value of the corresponding 1-bit data is "0." When each of the linear motor mechanisms 24 is determined to be used, the value of the corresponding 1-bit data is "1." Alternatively, the value of the corresponding 1-bit data may be "0" when each of the linear motor mechanisms 24 is determined to be used, and be "1" when each of the linear motor mechanisms 24 is determined to be unused.

For example, when all of the five linear motor mechanisms 24 are to be used (in corresponding relation to the first case), D=(1, 1, 1, 1, 1). When only the linear motor mechanism 24*d* is registered as a linear motor mechanism to be unused because of a malfunction and the like (in corresponding relation to the second case), D=(1, 1, 1, 0, 1). When the linear motor mechanism 24*c* and 24*d* are registered as linear motor mechanisms to be unused (in corresponding relation to the third case), the 5-bit data D=(1, 1, 0, 0, 1) is generated.

Next, whether to provide the intermittent supply or not is judged in the supply timing determination part 92, based on the linear setting data D (in Step S3). Whether to provide the intermittent supply or not is determined by whether there is a table 20 to be transported by the chain 23 or not. Specifically, when $x+y \geqq z$, it is judged to be necessary to provide the intermittent supply, and the process in Step S4 is subsequently performed. When $x+y<z$ in the linear transport section, it is not judged to be necessary to provide the intermittent supply, and the process in Step S6 is subsequently performed.

When it is judged to be necessary to provide the intermittent supply, the supply timing determination part 92 determines the supply timing of the recording media RM so as to provide the intermittent supply (in Step S4). Specifically, when the ten tables 20 to be sequentially transported are to be transported by the chain 23 as an alternative is determined in accordance with the information described in the linear setting data D and specifying the use or non-use of the linear motor mechanisms 24*a* to 24*e*. In accordance with such a corresponding relationship, a determination is made as to whether the supply part 2 supplies a recording medium RM to each of the tables 20 or not (i.e., whether the supply part 2 provides the intermittent supply or not).

Figure 23:
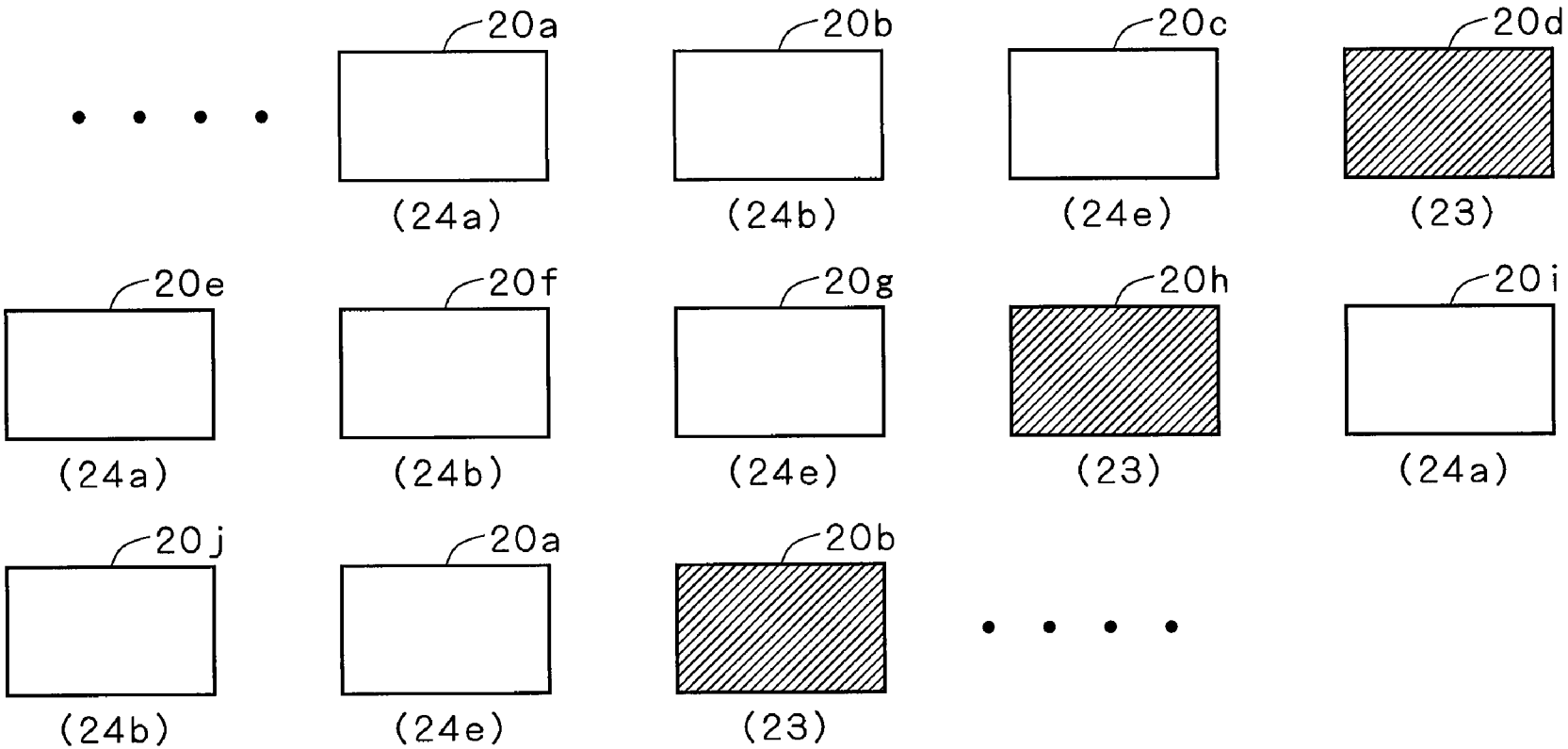
FIG. 23 is a view for illustration of the timing of intermittent supply.

FIG. 23 is a view for illustration of the supply timing of the recording media RM which is determined by the supply timing determination part 92 when the linear motor mechanisms 24*c* and 24*d* are to be unused (in corresponding relation to the third case). A corresponding relationship between the tables 20*a* to 20*j* and the linear motor mechanisms 24*a* to 24*e* (i.e., the movable elements 66*a* to 66*e*) for transporting the tables 20*a* to 20*j* is shown in FIG. 23.

In FIG. 23 are shown the liner motor mechanisms 24*a* to 24*e* or the chain 23 responsible for the transport of the tables 20*a* to 20*j* in the linear transport section. The tables 20 transported by the chain 23 are diagonally shaded in FIG. 23. When the linear motor mechanism 24 to be unused is not determined, the table 20*a*, 20*b*, 20*c*, 20*d*, 20*e*, 20*f*, . . . (repeated) shall be transported sequentially by the linear motor mechanisms 24*a*, 24*b*, 24*c*, 24*d*, 24*e*, 24*a*, . . . (repeated). In other words, the order in which the tables 20*a* to 20*j* are transported in the linear transport section is shown from the upper left in FIG. 23.

In the third case where D=(1, 1, 0, 0, 1), the table 20*a* is initially transported by the movable element 66*a* of the linear motor mechanism 24*a*, and the tables 20*b* is then transported by the movable element 66*b* of the linear motor mechanism 24*b*, as sequentially shown in FIGS. 19 to 21. The table 20*c* to be transported next is transported by the movable element 66*e* of the linear motor mechanism 24*e* because the originally scheduled linear motor mechanism 24*c* and also the linear motor mechanism 24*d* are to be unused.

Subsequently, the table 20*d* is transported to the first end position of the linear transport section closer to the supply part 2 and serves as the next table to be transported in the linear transport section. At this point, however, there is no linear motor mechanism 24 which can transport the table 20*d*. Thus, the table 20*d* is transported by the chain 23.

Thereafter, the tables 20*e*, 20*f* and 20*g* are transported by using the linear motor mechanisms 24*a*, 24*b* and 24*e*, respectively, and the table 20*h* is transported by the chain 23 in a similar manner. Further, the tables 20*i*, 20*j* and 20*a* are transported by using the linear motor mechanisms 24*a*, 24*b* and 24*e*, respectively, and the table 20*b* is transported by the chain 23.

In the third case where D=(1, 1, 0, 0, 1) as described above, three tables 20 are transported by the linear motor mechanisms 24*a*, 24*b*, 24*e*, and subsequently one table is transported by the chain 23. In other words, every fourth table 20 starting with the table 20*d* is transported by the chain 23 as an alternative. In such a case, the supply timing determination part 92 determines the supply timing of the recording media RM from the supply part 2 so that no recording medium RM is supplied to every fourth table 20 as mentioned above. During the image recording, the supply control part 82 controls the supply part 2 so that the supply part 2 supplies the recording media RM to the tables 20 in accordance with such supply timing.

Next, the recording medium detection control part 93 makes setting so as to exclude a table 20 to which no recording medium RM is supplied because of the transport by the chain 23 as an alternative from the tables 20 to be detected by the recording medium detection sensor 6 (in Step S5). This intentionally excludes the table 20 to which no recording medium RM is supplied and which is transported by the chain 23 as an alternative from the tables 20 to be subjected to the error detection in the recording medium detection sensor 6 in the image recording apparatus 100.

After the processes in Steps S1 to S5 are completed, the image recording is performed (in Step S6). Specifically, the transport control part 83 places the transport mechanism 3 in operation. Also, the supply part 2 supplies the recording media RM to the tables 20 under the control of the supply control part 82, and the inkjet heads 4H eject ink under the control of the ejection control part 84, whereby the image recording is achieved. More specifically, when the intermittent supply of the recording media RM is not provided, the recording media RM are transported to all of the tables 20. On the other hand, when the intermittent supply of the recording media RM is provided, the intermittent supply is provided in accordance with the supply timing determined in Step S4. At the time that the table 20 to be transported by the chain 23 as an alternative is transported in the linear transport section when the intermittent supply is provided, the supply control part 82 effects control so that the supply sucker 13 attracts under suction no recording medium RM placed on or stocked in the pre-recording stocking part 10.

As described hereinabove, the image recording apparatus 100 according to this preferred embodiment is capable of determining at least one of the linear motor mechanisms 24 to be unused for the transport to record an image without using the determined linear motor mechanism 24. Additionally, when the sum of the number of linear motor mechanisms 24 determined to be unused and the number of tables 20 transported at the same time in the linear transport section is less than the number of linear motor mechanisms 24 provided in the image recording apparatus 100, the linear motor mechanisms 24 except the linear motor mechanism 24 determined to be unused are used to transport the tables 20. When the above-mentioned sum is not less than the number of linear motor mechanisms 24 provided in the image recording apparatus 100, the chain 23 is used as an alternative for the transport. Thus, if a malfunctioning linear motor mechanism 24 is present because of a breakage, an operation anomaly and the like, the image recording apparatus 100 is capable of achieving the image recording although the throughput thereof decreases, to thereby suppress the reduction in productivity, as compared with the complete stop of the image recording apparatus 100.

Additionally, the supply part 2 is configured to supply no recording medium RM to the table 20 which cannot be transported by the linear motor mechanisms 24 but is required to be transported by the chain 23 as an alternative in the linear transport section. Thus, if at least one of the linear motor mechanisms 24 cannot be used for the transport because of a breakage, a malfunction and the like, the image recording apparatus 100 is capable of maintaining the accuracy of image recording as high as that obtained when there is no linear motor mechanism 24 determined to be unused.

<Modifications>

Although the image recording apparatus 100 is described as an inkjet printer in the above-mentioned preferred embodiment, the application of the present invention is not limited to an apparatus for recording an image based on inkjet technology.

Although the transport mechanism 3 includes the ten tables 20 in the above description, the number of tables 20 provided in the transport mechanism 3 is not limited to ten.

Although the transport mechanism 3 includes the five linear motor mechanisms 24 in the above description, the number of linear motor mechanisms 24 provided in the transport mechanism 3 is not limited to five.

The order in which the plurality of linear motor mechanisms 24 are used to transport the tables 20 is not limited to that shown in FIGS. 13 to 21.

Although the linear motor mechanisms 24 are capable of transporting a maximum of three tables 20 at the same time in the above description, the maximum number of tables 20 transported by the linear motor mechanisms 24 at the same time is not limited to three.

While the invention has been described in detail, the foregoing description is in all aspects illustrative and not restrictive. It is understood that numerous other modifications and variations can be devised without departing from the scope of the invention.

What is claimed is:

1. An image recording apparatus comprising:

a) an image recording part for recording an image on recording media; and b) a recording medium transport device for transporting said recording media stocked in a predetermined stocking part, said recording medium transport device including b-1) a plurality of tables for holding said recording media thereon, b-2) a supply part for supplying said recording media to each of said plurality of tables, b-3) a plurality of linear motor mechanisms for transporting said plurality of tables in a first transport section including at least an area in which said image recording part records an image on said recording media, b-4) an endless transport mechanism for transporting said plurality of tables in at least a second transport section contiguous with said first transport section and capable of transporting said plurality of tables in said first transport section, and b-5) an unused linear motor mechanism determination part for determining an unused linear motor mechanism to be unused for the transport of said plurality of tables from among said plurality of linear motor mechanisms, said plurality of linear motor mechanisms and said endless transport mechanism being provided so that said plurality of tables are used sequentially and circularly for the transport in said first transport section, wherein, when said unused linear motor mechanism is not determined, all of said plurality of linear motor mechanisms are used for the transport of said plurality of tables in said first transport section, and wherein, when said unused linear motor mechanism is determined, said endless transport mechanism is used as an alternative to transport at least one of said plurality of tables which is to be transported in said first transport section but which is able to be transported by none of said plurality of linear motor mechanisms.

2. The image recording apparatus according to claim 1, wherein:

said recording medium transport device further includes b-6) a supply timing determination part for determining supply timing indicative of when to supply said recording media from said supply part in accordance with the condition of transport of said plurality of tables, said supply timing determination part determining said supply timing so that, if an alternative transport table to be transported by said endless transport mechanism as an alternative in said first transport section is present among said plurality of tables, said recording media are not supplied from said supply part to said alternative transport table; and said supply part supplies said recording media to said plurality of tables, based on said supply timing determined by said supply timing determination part.

3. The image recording apparatus according to claim 2, wherein said recording medium transport device further includes b-7) a recording medium detection sensor for detecting whether said plurality of tables hold said recording media, respectively, thereon or not in a transport path of said recording media, said recording medium detection sensor excluding said alternative transport table from the plurality of tables to be detected.

4. The image recording apparatus according to claim 1, wherein said unused linear motor mechanism stops its operation in accordance with the determination of said unused linear motor mechanism determination part.

5. The image recording apparatus according to claim 1, wherein:

the number of linear motor mechanisms provided in said recording medium transport device is greater by at least two than a simultaneous transport table count which is the number of tables included among said plurality of tables and transported at the same time in said first transport section;

said plurality of linear motor mechanisms except said unused linear motor mechanism are used to transport said plurality of tables in said first transport section when the sum of the number of unused linear motor mechanisms and said simultaneous transport table count is less than the number of linear motor mechanisms provided in said recording medium transport device; and said endless transport mechanism is used as an alternative for the transport only when the sum of the number of unused linear motor mechanisms and said simultaneous transport table count is not less than the number of linear motor mechanisms provided in said recording medium transport device.

6. In an apparatus including an image recording part and for recording an image on recording media in the image recording part, a recording medium transport device for transporting said recording media stocked in a predetermined stocking part, comprising:

a plurality of tables for holding said recording media thereon;

a supply part for supplying said recording media to each of said plurality of tables;

a plurality of linear motor mechanisms for transporting said plurality of tables in a first transport section including at least an area in which said image recording part records an image on said recording media;

an endless transport mechanism for transporting said plurality of tables in at least a second transport section contiguous with said first transport section and capable of transporting said plurality of tables in said first transport section; and an unused linear motor mechanism determination part for determining an unused linear motor mechanism to be unused for the transport of said plurality of tables from among said plurality of linear motor mechanisms, said plurality of linear motor mechanisms and said endless transport mechanism being provided so that said plurality of tables are used sequentially and circularly for the transport in said first transport section, wherein, when said unused linear motor mechanism is not determined, all of said plurality of linear motor mechanisms are used for the transport of said plurality of tables in said first transport section, and wherein, when said unused linear motor mechanism is determined, said endless transport mechanism is used as an alternative to transport at least one of said plurality of tables which is to be transported in said first transport section but which is able to be transported by none of said plurality of linear motor mechanisms.

7. The recording medium transport device according to claim 6, further comprising a supply timing determination part for determining supply timing indicative of when to supply said recording media from said supply part in accordance with the condition of transport of said plurality of tables, said supply timing determination part determining said supply timing so that, if an alternative transport table to be transported by said endless transport mechanism as an alternative in said first transport section is present among said plurality of tables, said recording media are not supplied from said supply part to said alternative transport table, wherein said supply part supplies said recording media to said plurality of tables, based on said supply timing determined by said supply timing determination part.

8. The recording medium transport device according to claim 7, further comprising a recording medium detection sensor for detecting whether said plurality of tables hold said recording media, respectively, thereon or not in a transport path of said recording media, said recording medium detection sensor excluding said alternative transport table from the plurality of tables to be detected.

9. The recording medium transport device according to claim 6, wherein said unused linear motor mechanism stops its operation in accordance with the determination of said unused linear motor mechanism determination part.

10. The recording medium transport device according to claim 6, wherein:

the number of linear motor mechanisms provided in said recording medium transport device is greater by at least two than a simultaneous transport table count which is the number of tables included among said plurality of tables and transported at the same time in said first transport section;

said plurality of linear motor mechanisms except said unused linear motor mechanism are used to transport said plurality of tables in said first transport section when the sum of the number of unused linear motor mechanisms and said simultaneous transport table count is less than the number of linear motor mechanisms provided in said recording medium transport device; and said endless transport mechanism is used as an alternative for the transport only when the sum of the number of unused linear motor mechanisms and said simultaneous transport table count is not less than the number of linear motor mechanisms provided in said recording medium transport device.

* * * * *